US011787206B2

(12) United States Patent
Nishihara et al.

(10) Patent No.: US 11,787,206 B2
(45) Date of Patent: Oct. 17, 2023

(54) MEDIUM HAVING HEAT-SENSITIVE MEDIUM AND ADHESIVE MEDIUM WHOSE WIDTH IS GREATER THAN WIDTH OF HEAT-SENSITIVE MEDIUM, CARTRIDGE INCLUDING THE MEDIUM, AND METHOD FOR CREATING THE MEDIUM

(71) Applicant: BROTHER KOGYO KABUSHIKI KAISHA, Nagoya (JP)

(72) Inventors: Keisuke Nishihara, Nagoya (JP); Akira Minami, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/561,360

(22) Filed: Dec. 23, 2021

(65) Prior Publication Data

US 2022/0203726 A1 Jun. 30, 2022

(30) Foreign Application Priority Data

Dec. 28, 2020 (JP) ..... 2020-219010

(51) Int. Cl.
*B41M 5/30* (2006.01)
*B41J 15/04* (2006.01)
*B41M 5/382* (2006.01)

(52) U.S. Cl.
CPC ..... *B41J 15/044* (2013.01); *B41M 5/38214* (2013.01)

(58) Field of Classification Search
CPC ..... B41M 5/38214; B41J 15/044
USPC ..... 428/32.84
See application file for complete search history.

(56) References Cited

U.S. PATENT DOCUMENTS

2001/0053746 A1* 12/2001 Suzuki ..... B41M 5/287 503/214
2019/0061375 A1 2/2019 Matsumoto
2022/0203726 A1* 6/2022 Nishihara ..... B41M 5/38214

FOREIGN PATENT DOCUMENTS

CN 1785685 A * 6/2006 ..... B41J 15/044
JP 2008-006830 A 1/2008
JP 2013-208786 A 10/2013
JP 2017-177438 A 10/2017
WO 02/096665 A1 12/2002

OTHER PUBLICATIONS

Temperature Indication Belt And The Manufacturing Device of Label With The Indication OF, CN 1785685 A (Year: 2006).*

* cited by examiner

*Primary Examiner* — Betelhem Shewareged
(74) *Attorney, Agent, or Firm* — Kenealy Vaidya LLP

(57) ABSTRACT

A medium includes: a heat-sensitive medium and an adhesive medium laminated over the heat-sensitive medium in a thickness direction thereof. The heat-sensitive medium includes a base material and a first heat-sensitive layer configured to produce a first color when heated above a first temperature. The first heat-sensitive layer is positioned between the base material and the adhesive medium in the thickness direction. The adhesive medium includes an adhesive-medium base material and an adhesive layer provided at the adhesive-medium base material. The adhesive medium defines a width greater than a width of the heat-sensitive medium in a width direction thereof crossing the thickness direction.

16 Claims, 19 Drawing Sheets

MEDIUM HAVING HEAT-SENSITIVE MEDIUM AND ADHESIVE MEDIUM WHOSE WIDTH IS GREATER THAN WIDTH OF HEAT-SENSITIVE MEDIUM, CARTRIDGE INCLUDING THE MEDIUM, AND METHOD FOR CREATING THE MEDIUM

CROSS REFERENCE TO RELATED APPLICATIONS

This application claims priority from Japanese Patent Application No. 2020-219010 filed Dec. 28, 2020. The entire content of the priority application is incorporated herein by reference.

BACKGROUND

Japanese Patent Application Publication No. 2017-177438 discloses a cartridge, a thermal printer, a heat-sensitive medium, and an adhesive medium. The heat-sensitive medium and adhesive medium are accommodated in the cartridge. The heat-sensitive medium has a heat-sensitive layer, a first protective layer, and a second protective layer. The heat-sensitive layer produces a single color when heated. The first protective layer and second protective layer are respectively provided on opposite sides of the heat-sensitive layer in a thickness direction of the medium to protect the heat-sensitive layer. The cartridge is detachably mountable in the thermal printer. The thermal printer performs printing while the cartridge is mounted therein by heating the heat-sensitive medium from the side of the second protective layer to develop the single color in the heat-sensitive medium. The adhesive medium includes an adhesive layer and a base material. The adhesive layer of the adhesive medium is bonded to the second protective layer of the heat-sensitive medium to produce a laminated medium printed in the single color.

SUMMARY

In the conventional technology described above, edges of the stacked layers are exposed in widthwise endfaces of the laminated medium. Thus, the conventional laminated medium may suffer from poor durability due to moisture penetrating between layers in the widthwise edges of the laminated medium, for example.

In view of the foregoing, it is an object of the present disclosure to provide a medium having high durability, a cartridge including the medium, and a method of creating the medium.

In order to attain the above and other object, according to one aspect, the present disclosure provides a medium for use in a thermal printer. The medium includes a heat-sensitive medium and an adhesive medium. The heat-sensitive medium defines a thickness in a thickness direction and a width in a width direction crossing the thickness direction. The heat-sensitive medium includes a base material, and a first heat-sensitive layer configured to produce a first color when heated above a first temperature. The adhesive medium is laminated over the heat-sensitive medium in the thickness direction. The first heat-sensitive layer is positioned between the base material and the adhesive medium in the thickness direction. The adhesive medium includes an adhesive-medium base material and adhesive layer provided at the adhesive-medium base material. The adhesive medium defines a width greater than the width of the heat-sensitive medium in the width direction.

With this configuration, since the width of the adhesive medium is larger than the width of the heat-sensitive medium in the width direction, the adhesive medium protrudes out from the edges of the heat-sensitive medium in the width direction when the heat-sensitive medium and adhesive medium are bonded together. Accordingly, the heat-sensitive medium and adhesive medium are bonded together such that the portions of the adhesive medium that protrude from the heat-sensitive medium in the width direction ("protruding width portions") cover the widthwise end faces of the heat-sensitive medium By covering the widthwise end faces of the heat-sensitive medium with the adhesive medium in this way, the resultant medium can improve durability thereof with respect to moisture penetration, dirt adhesion, wear, and the like at the widthwise end faces of the heat-sensitive medium owing to the portion of the adhesive medium covering the heat-sensitive medium.

According to another aspect, the present disclosure also provides a cartridge including a case, a first supporting portion, and a second supporting portion. The case accommodating the medium according to the one aspect. The first supporting portion is provided at the case for supporting the heat-sensitive medium inside the case. The second supporting portion is provided at the case for supporting the adhesive medium inside the case.

With this configuration, the same technical advantages as the one aspect can be achieved.

According to still another aspect, the present disclosure also provides a method for creating the medium according to the one aspect. The method includes: a printing step to apply heat to the heat-sensitive medium to form an image in the heat-sensitive medium; and a laminating step to bond the adhesive medium to the heat-sensitive medium on which the image is formed to create the medium.

With this configuration, the same technical advantages as the one aspect can be achieved.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

Hereinafter, an embodiment of the present disclosure will be described while referring to FIGS. 1 through 14. The referenced drawings are used to describe the technical features made possible with the present disclosure. The configurations, control, and the like of the apparatuses described below are merely examples, and the present disclosure is not limited to these described configurations, control, and the like.

Figure 1:
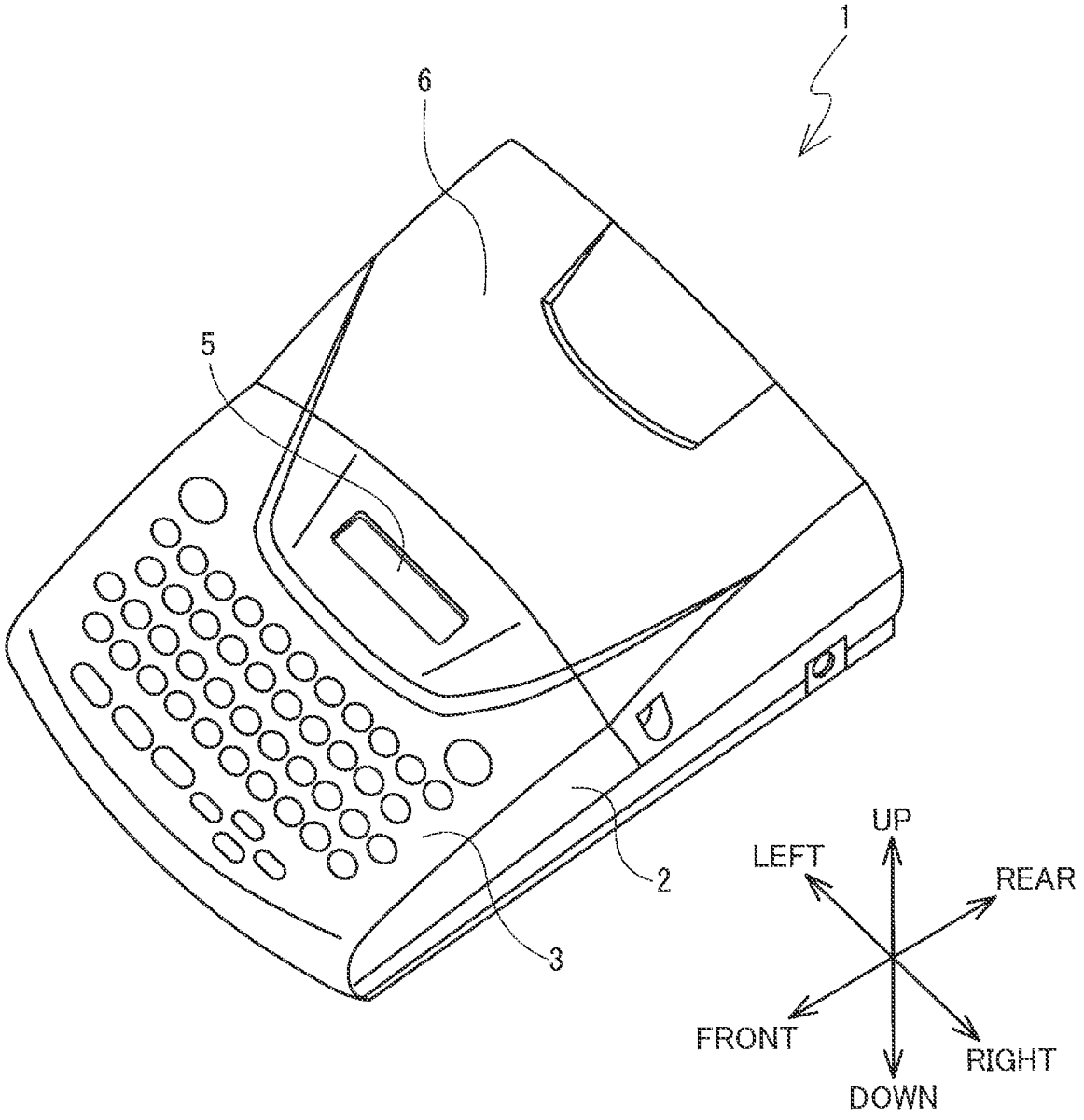
FIG. 1 is a perspective view of a thermal printer 1.
Figure 2:
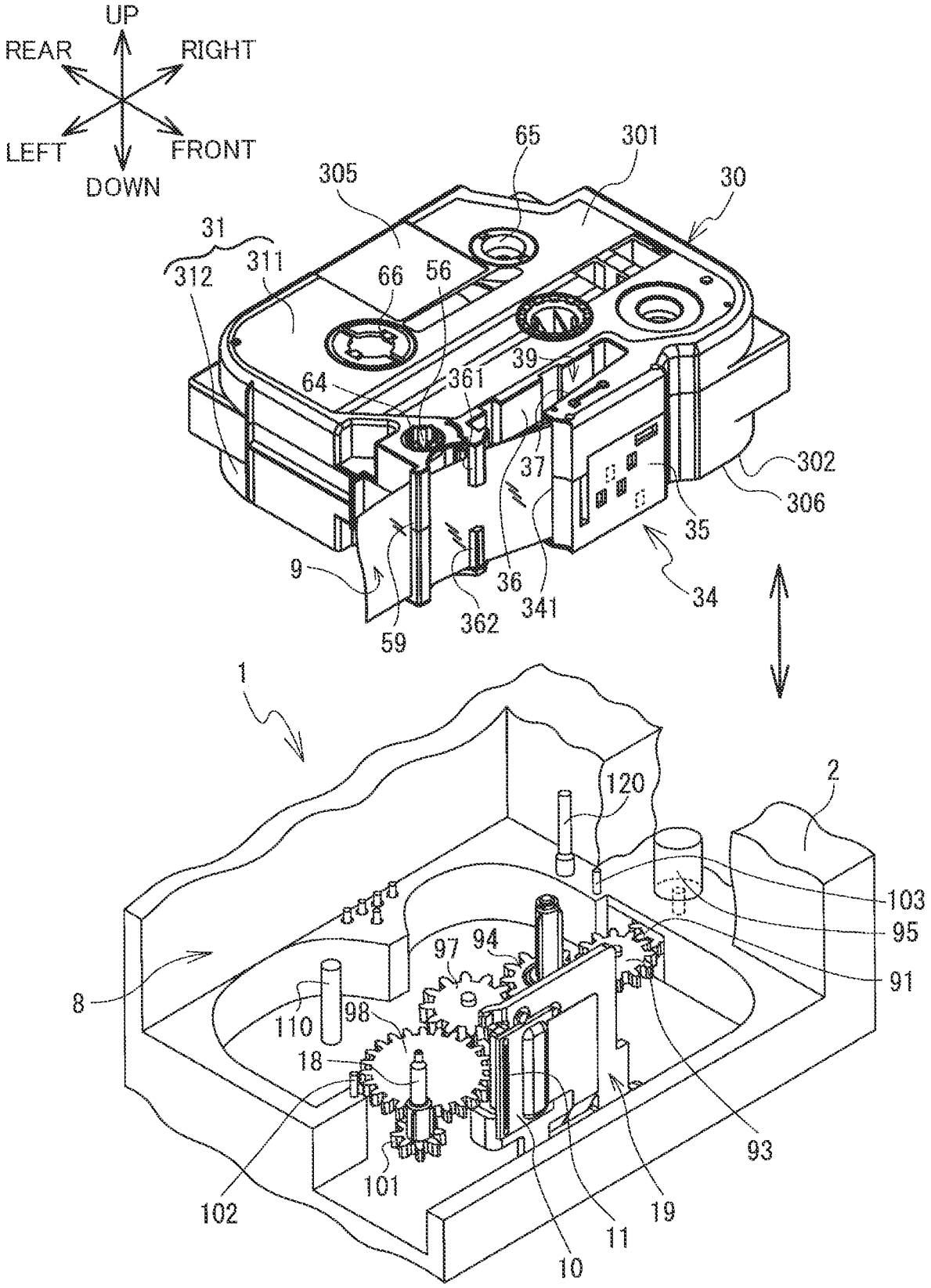
FIG. 2 is a perspective view of a tape cassette 30 and an attachment portion 8 of the thermal printer 1.

In the following description, the lower-left side, upper-right side, lower-right side, upper-left side, top side, and bottom side of a thermal printer 1 depicted in FIG. 1 are respectively defined as the front side, rear side, right side, left side, top side, and bottom side of the thermal printer 1. The lower-right side, upper-left side, upper-right side, lower-left side, top side, and bottom side of a tape cassette 30 depicted in FIG. 2 are respectively defined as the front side, rear side, right side, left side, top side, and bottom side of the tape cassette 30. Further, in FIGS. 3 and 4, the tape cassette 30 mounted in an attachment portion 8 of the thermal printer 1 is depicted without an upper case 311 to facilitate understanding.

A printing system according to the present embodiment includes the thermal printer 1 (see FIG. 1), and the tape cassette 30 (see FIG. 2). Using the tape cassette 30, the thermal printer 1 can print alphanumeric characters, symbols, graphics, and the like on a heat-sensitive tape 4. Subsequently, an adhesive tape 7 is bonded to the heat-sensitive tape 4 to create a laminated tape 9.

External Structure of the Thermal Printer 1

As illustrated in FIG. 1, the thermal printer 1 includes a device body 2. The device body 2 has a box shape. A keyboard 3 is provided on a front surface of the device body 2 in a front portion thereof. A user can input various types of information into the thermal printer 1 by operating the keyboard 3. A display 5 is provided in a top surface of the device body 2 to the rear of the keyboard 3. The display 5 can display the information inputted by the user.

A cassette cover 6 is provided to the rear of the display 5. The cassette cover 6 can be opened and closed on the device body 2 for exposing or covering the attachment portion 8 described later (see FIG. 2). The user opens and closes the cassette cover 6 when replacing the tape cassette 30 (see FIG. 2). A discharge slit (not shown) is formed in a left side surface of the device body 2 in a rear portion thereof. The discharge slit allows the laminated tape 9 to be discharged from the thermal printer 1.

Internal Structure of the Thermal Printer 1

As illustrated in FIG. 2, the attachment portion 8 is provided inside the device body 2 below the cassette cover 6 (see FIG. 1). The attachment portion 8 is a recessed part that is recessed downward from the top surface of the device body 2 with a shape in conformance with a shape of the tape cassette 30. Thus, when the cassette cover 6 is open, the tape cassette 30 can be mounted in and removed from the attachment portion 8. A head holder 19 is disposed in a front section of the attachment portion 8. The head holder 19 has a plate-like shape and extends in vertical and left-right directions. The head holder 19 has a front surface 191 (see FIG. 2). A thermal head 10 is provided on the front surface 191 of the head holder 19. The thermal head 10 includes a plurality of heating elements 11. The heating elements 11 are arranged in line with respect to the vertical direction. In printing, the thermal head 10 applies heat with the heating elements 11 to the heat-sensitive tape 4 exposed through an opening 341 (described later) while the tape cassette 30 is mounted in the attachment portion 8.

Two positioning pins 102 and 103 are provided at two locations in the attachment portion 8. Specifically, the positioning pin 102 is provided in a left-side section of the attachment portion 8, and the positioning pin 103 is provided in a right-side section of the attachment portion 8. When the tape cassette 30 is mounted in the attachment portion 8, the positioning pins 102 and 103 are respectively inserted into pinholes 62 and 63 formed in a cassette case 31 described later (see FIG. 7).

A conveying motor 95 is arranged at a position outside of the attachment portion 8 (specifically, at the upper-right side in FIG. 2). The conveying motor 95 is configured as a stepping motor. A gear 91 is fixed to a lower end of a drive shaft of the conveying motor 95. The gear 91 is coupled to a gear 101 via gears 93, 94, 97 and 98. A drive shaft 18 is disposed in an upright state on a top surface of the gear 101. A conveying roller 56 (described later) of the tape cassette 30 is detachably mountable on the drive shaft 18. The conveying motor 95 is configured to drive the drive shaft 18 to rotate. When the drive shaft 18 is rotated, the conveying roller 56 conveys the heat-sensitive tape 4 and adhesive tape 7 described later.

An auxiliary shaft 110 is disposed in an upright state in the attachment portion 8 to the rear side of the gear 98. The auxiliary shaft 110 has a substantially columnar shape and can be removably inserted into a support hole part 66 (described later) of the tape cassette 30. An auxiliary shaft 120 is disposed in an upright state in a right-rear section of the attachment portion 8 and to the rear of the positioning pin 103. The auxiliary shaft 120 is removably inserted into a guide hole 57 (described later) of the tape cassette 30.

Figure 3:
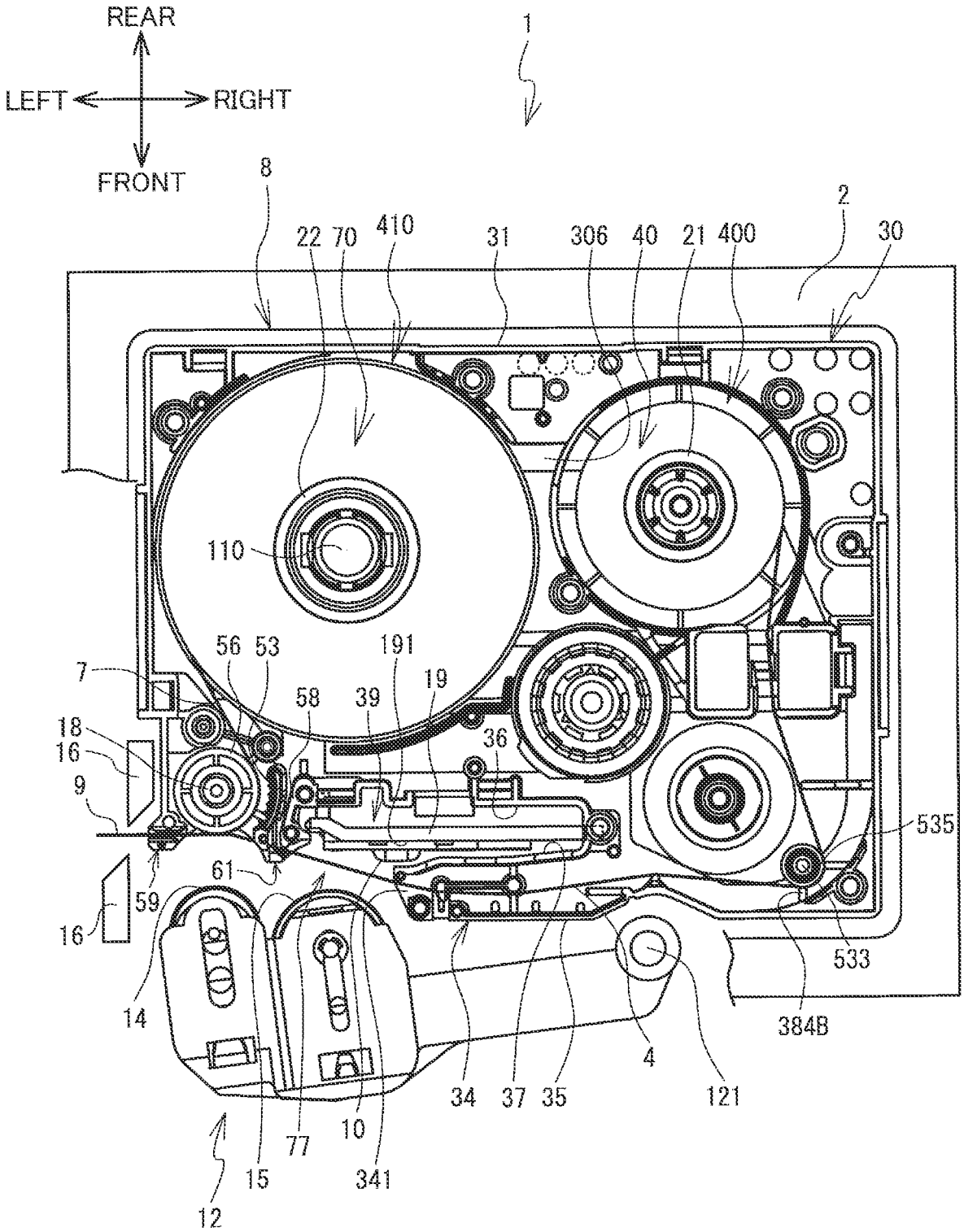
FIG. 3 is a plan view of the attachment portion 8 to which the tape cassette 30 is attached when a platen holder 12 is at a standby position.

As illustrated in FIG. 3, a cutting mechanism 16 is provided in the device body 2 on the left side of the drive shaft 18. The cutting mechanism 16 is configured to be driven by a cutting motor 96 (see FIG. 13) provided in the thermal printer 1. When driven by the cutting motor 96, the cutting mechanism 16 cuts the laminated tape 9. A platen holder 12 is provided in the device body 2 on the front side of the head holder 19. The platen holder 12 is an arm-like member and is pivotably supported by a support shaft 121 whose axis is aligned in the vertical direction. The support shaft 121 is disposed on a right end of the platen holder 12.

A platen roller 15 and a pinch roller 14 are rotatably supported on a free end portion of the platen holder 12. The platen roller 15 is configured to contact and separate from the thermal head 10 in accordance with the pivotal movement of the platen holder 12. The pinch roller 14 is disposed on the left side of the platen roller 15. The pinch roller 14 is configured to contact and separate from the conveying roller 56 (described later) in accordance with the pivotal movement of the platen holder 12.

In the present embodiment, the platen holder 12 is configured to move toward a standby position (the position shown in FIG. 3) when the cassette cover 6 is open, and to move toward a printing position (the position shown in FIG. 4) when the cassette cover 6 is closed. In the standby position, the platen holder 12 is separated from the attachment portion 8. Accordingly, the tape cassette 30 can be mounted in or removed from the attachment portion 8.

In the printing position, the platen holder 12 is positioned adjacent to the attachment portion 8. Accordingly, when the tape cassette 30 is mounted in the attachment portion 8 and the cassette cover 6 is closed, the platen roller 15 presses the heat-sensitive tape 4 against the thermal head 10, and the pinch roller 14 presses the heat-sensitive tape 4 and adhesive tape 7 against the conveying roller 56 such that the heat-sensitive tape 4 and adhesive tape 7 are overlapped with each other.

The conveying motor 95 (see FIG. 2) drives the platen roller 15 to rotate together with the drive shaft 18. In order to avoid slack in the heat-sensitive tape 4 during conveyance of the heat-sensitive tape 4, the platen roller 15 is coupled to the conveying motor 95 through a plurality of gears (not shown) so that a rotational speed of the platen roller 15 is slower than a rotational speed of the drive shaft 18 (the conveying roller 56).

Structure of the Tape Cassette 30

Figure 5:
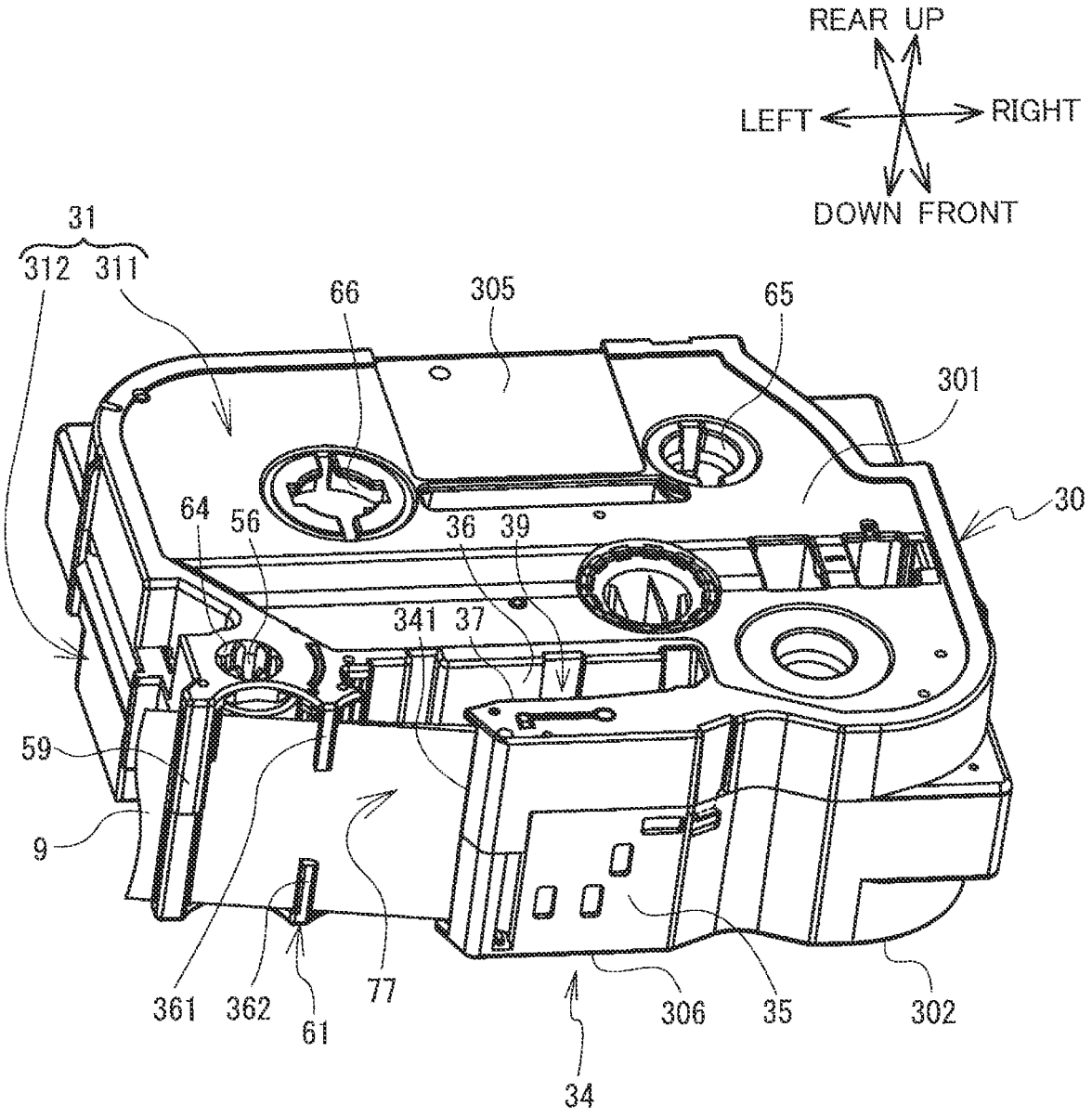
FIG. 5 is a perspective view of the tape cassette 30 as viewed from above.
Figure 6:
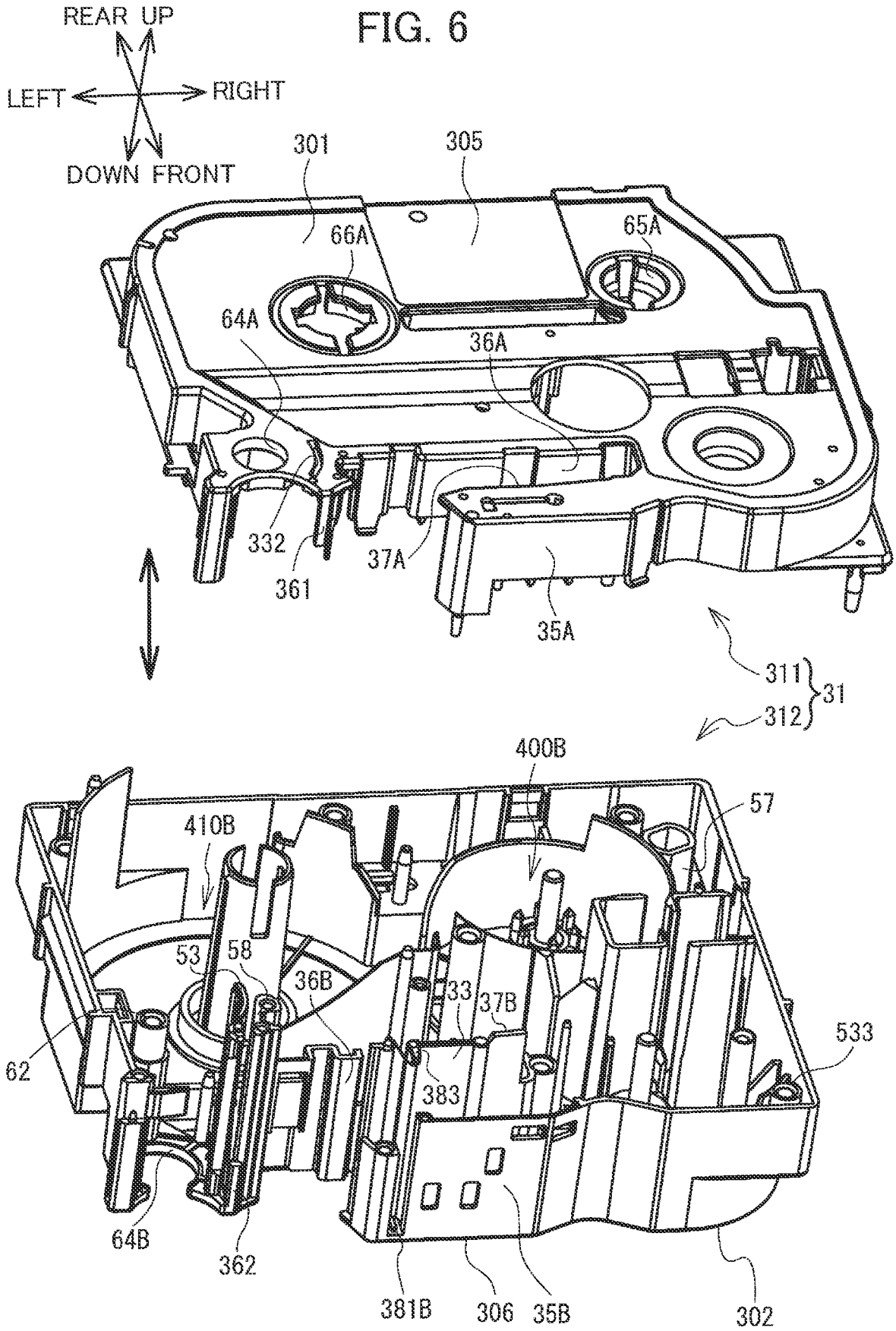
FIG. 6 is an exploded perspective view of a cassette case 31 disassembled into an upper case 311 and a lower case 312.

As illustrated in FIGS. 5 and 6, the tape cassette 30 includes the cassette case 31. The cassette case 31 has a substantially rectangular parallelepiped shape and is configured by a combination of the upper case 311 and a lower case 312. The upper case 311 has a box-like shape that opens downward. The upper case 311 includes a top plate 305 (see FIG. 2) that forms a top surface 301 of the cassette case 31. The lower case 312 has a box-like shape that opens upward. The lower case 312 includes a bottom plate 306 that forms a bottom surface 302 of the cassette case 31. The upper case 311 is fixed to the top of the lower case 312. A distance from the bottom surface 302 to the top surface 301 is coincident with a height of the tape cassette 30 or cassette case 31.

Figure 7:
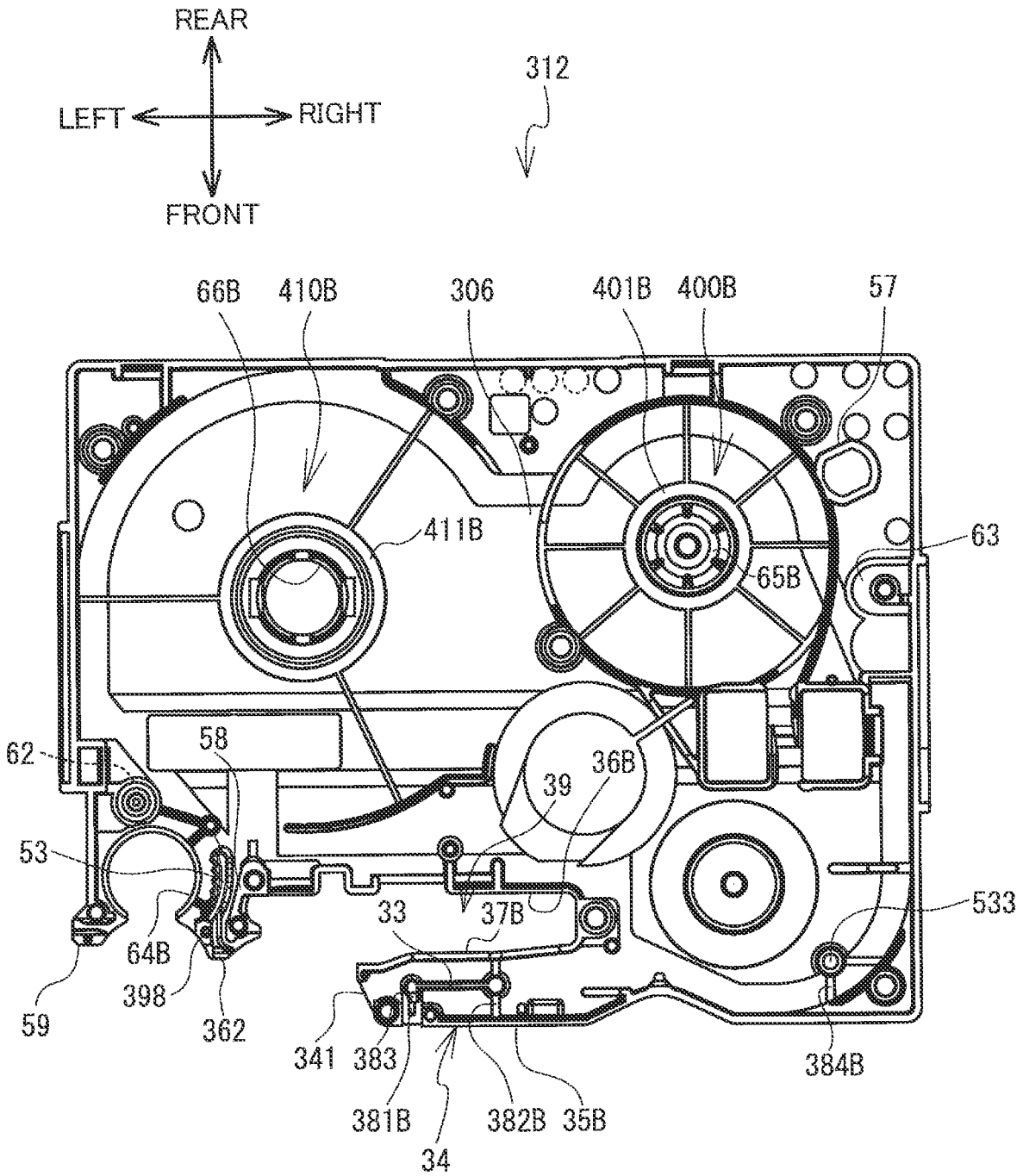
FIG. 7 is a plan view of the lower case 312.

As illustrated in FIG. 7, the pinholes 62 and 63 are provided in the bottom surface 302 of the cassette case 31 at two locations corresponding to the positioning pins 102 and 103 of the thermal printer 1. Specifically, the pinhole 62 is provided in a left-front portion of the cassette case 31 as a recess in the bottom surface 302 in which the positioning pin 102 is inserted. The pinhole 63 is provided in a right-rear portion of the cassette case 31 as a recess in the bottom surface 302 in which the positioning pin 103 is inserted.

As illustrated in FIG. 5, support hole parts 65 and 66 are formed in the cassette case 31. The support hole parts 65 and 66 rotatably support tape spools 21 and 22 (see FIG. 3) that are mounted in the cassette case 31. The support hole part 65 vertically penetrates the right-rear portion of the cassette case 31. The support hole part 66 vertically penetrates a left-rear portion of the cassette case 31 to the left of the support hole part 65. The auxiliary shaft 110 is inserted into the support hole part 66 while the tape cassette 30 is mounted in the attachment portion 8.

Figure 4:
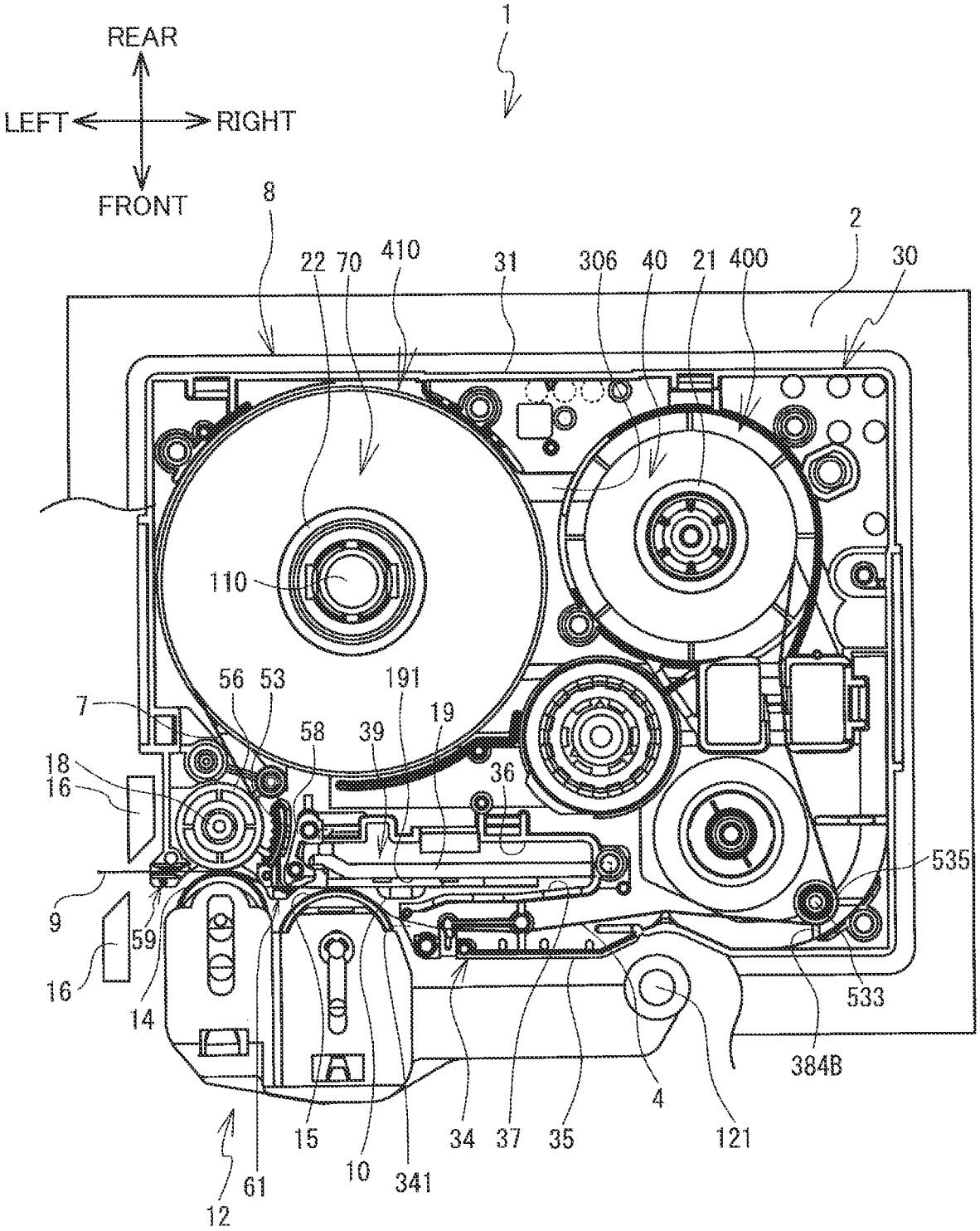
FIG. 4 is a plan view of the attachment portion 8 to which the tape cassette 30 is attached when the platen holder 12 is at a printing position.

As illustrated in FIGS. 3 and 4, the heat-sensitive tape 4 described later is wound clockwise in a plan view around the tape spool 21 so as to gradually separate from a rotational center of the tape spool 21. Specifically, the heat-sensitive tape 4 is wound about the tape spool 21 such that a plurality of heat-sensitive layers 42 (see FIG. 10A) is on the inside of a base material 41 described later (see FIG. 10A). The feed source of the heat-sensitive tape 4 configured in this way will be called a first supply roll 40.

The adhesive tape 7 is wound counterclockwise in a plan view about the tape spool 22 so as to gradually separate from a rotational center of the tape spool 22. Specifically, the adhesive tape 7 is wound about the tape spool 22 such that a first adhesive layer 73 described later (see FIG. 10B) is on the inside of a second adhesive layer 74 (and a release paper 75; see FIG. 10B). The feed source of the adhesive tape 7 configured in this way will be called a second supply roll 70.

As illustrated in FIGS. 3 and 4, tape areas 400 and 410 are provided inside the cassette case 31. The tape areas 400 and 410 can accommodate the first supply roll 40 and second supply roll 70, respectively. The heat-sensitive tape 4 and adhesive tape 7 are accommodated and conveyed in the cassette case 31 with their respective width dimensions oriented in the vertical direction of the tape cassette 30.

The tape area 400 is provided in the right-rear portion of the cassette case 31 and has a substantially circular shape in a plan view. The support hole part 65 is provided in an approximate center region of the tape area 400 in a plan view. An upper tape area 400A constituting an upper portion of the tape area 400 is provided in the upper case 311 (see FIG. 8). A lower tape area 400B constituting a lower portion of the tape area 400 is provided in the lower case 312 (see FIG. 7).

Figure 8:
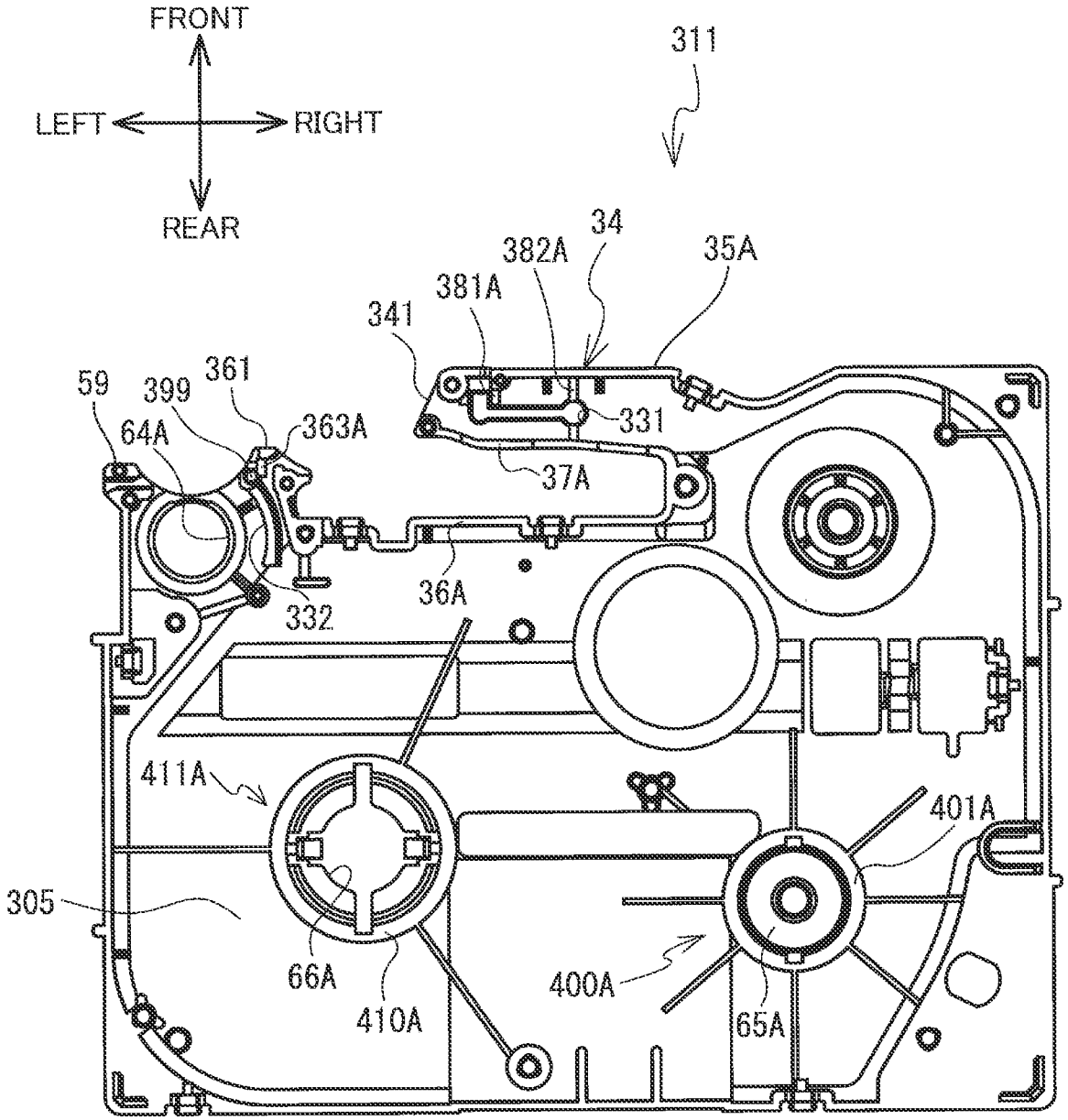
FIG. 8 is a bottom view of the upper case 311.

As illustrated in FIG. 8, an upper restricting part 401A is provided in the upper tape area 400A. The upper restricting part 401A protrudes slightly downward from the top plate 305. Specifically, an annular protruding part is provided in a central position of the upper tape area 400A where the tape spool 21 of the first supply roll 40 (see FIG. 3) is disposed. Eight linear protruding parts extend radially outward from this annular protruding part to a periphery of the upper tape area 400A. All of these protruding parts constitute the upper restricting part 401A. A support hole part 65A forming an upper portion of the support hole part 65 is provided in a center of the annular protruding part constituting the upper restricting part 401A.

As illustrated in FIG. 7, a lower restricting part 401B is provided in the lower tape area 400B. The lower restricting part 401B protrudes slightly upward from the bottom plate 306. Specifically, an annular protruding part is provided in a central position of the lower tape area 400B where the tape spool 21 of the first supply roll 40 (see FIG. 3) is disposed. Eight linear protruding parts extend radially outward from this annular protruding part to a periphery of the lower tape area 400B. All of these protruding parts constitute the lower restricting part 401B. A support hole part 65B forming a lower portion of the support hole part 65 is provided in a center of the annular protruding part constituting the lower restricting part 401B.

As illustrated in FIGS. 3 and 4, the tape area 410 has a substantially circular shape in a plan view and occupies an approximate left half of the interior of the cassette case 31. The support hole part 66 is provided in an approximate center portion of the tape area 410 in a plan view. An upper tape area 410A constituting an upper portion of the tape area 410 is provided in the upper case 311. A lower tape area 410B constituting a lower portion of the tape area 410 is provided in the lower case 312.

As illustrated in FIG. 8, an upper restricting part 411A is provided in the upper tape area 410A. The upper restricting part 411A protrudes slightly downward from the top plate 305. Specifically, an annular protruding part is provided in a central position of the upper tape area 410A where the tape spool 22 of the second supply roll 70 (see FIG. 3) is disposed. Three linear protruding parts extend radially outward from this annular protruding part to a periphery of the upper tape area 410A. All of these protruding parts constitute the upper restricting part 411A. A support hole part 66A that forms an upper portion of the support hole part 66 is provided in a center of the annular protruding part constituting the upper restricting part 411A.

As illustrated in FIG. 7, a lower restricting part 411B is provided in the lower tape area 410B. The lower restricting part 411B protrudes slightly upward from the bottom plate 306. Specifically, an annular protruding part is provided in a central position of the lower tape area 410B where the tape spool 22 of the second supply roll 70 (see FIG. 3) is disposed. Three linear protruding parts extend radially outward from this annular protruding part to a periphery of the lower tape area 410B. All of these protruding parts constitute the lower restricting part 411B. A support hole part 668 forming a lower portion of the support hole part 66 is provided in a center of the annular protruding part constituting the lower restricting part 411B.

As illustrated in FIGS. 6 and 7, the guide hole 57 is provided rightward of the lower tape area 400B and rearward of the pinhole 63. The auxiliary shaft 120 of the attachment portion 8 (see FIG. 2) is inserted into and extracted from the guide hole 57 when the tape cassette 30 is respectively mounted and removed. By inserting the positioning pins 102 and 103 and auxiliary shafts 110 and 120 (see FIG. 2) into the respective pinholes 62 and 63 (see FIG. 7), the support hole part 66 (see FIG. 5), and the guide hole 57, the tape cassette 30 is restricted from moving in the front, rear, left, and right directions when mounted in the attachment portion 8.

As illustrated in FIGS. 3, 4, and 7, a shaft 533 is disposed in an upright state on the bottom plate 306 in a right-front corner portion of the cassette case 31. The shaft 533 is inserted into a shaft hole of a roller member 535. The roller member 535 is a cylindrical-shaped rotatable body. The shaft 533 rotatably supports the roller member 535. A restricting part 384B is provided on a bottom end of the shaft 533. The restricting part 384B extends in the front-rear direction from the shaft 533 to a front wall of the lower case 312. The restricting part 384B is a plate-shaped member that extends slightly upward from the bottom plate 306. A height of the restricting part 384B above the bottom plate 306 is lower than a height of the shaft 533 above the bottom plate 306.

As illustrated in FIGS. 3 through 8, an arm part 34 is provided on the front side of the cassette case 31. The arm part 34 extends leftward and forward from a right-front portion of the cassette case 31. An arm front wall 35 constituting a front wall of the arm part 34 is configured of a combination of an upper arm front wall 35A (see FIGS. 6 and 8) provided in the upper case 311, and a lower arm front wall 35B (see FIGS. 6 and 7) provided in the lower case 312.

An arm rear wall 37 constituting a rear wall of the arm part 34 is configured of a combination of an upper arm rear wall 37A (see FIG. 8) provided in the upper case 311, and a lower arm rear wall 37B (see FIG. 7) provided in the lower case 312. The opening 341 is formed between a left end of the arm front wall 35 and a left end of the arm rear wall 37. The opening 341 has a slit-like shape that is elongated vertically.

As illustrated in FIG. 7, a restricting wall 33 is provided between the lower arm front wall 35B and lower arm rear wall 37B in the lower case 312. The restricting wall 33 is a wall part that extends upward from the bottom plate 306. The restricting wall 33 has a slightly greater height than the heat-sensitive tape 4 accommodated in the cassette case 31. Lower restricting parts 381B and 382B are respectively provided on left and right end portions of the restricting wall 33 at a bottom edge thereof. The lower restricting parts 381B and 382B extend slightly upward from the bottom plate 306 and also extend forward from the restricting wall 33 to the lower arm front wall 35B.

As illustrated in FIG. 6, a restricting part 383 is provided on the left end portion of the restricting wall 33 at a top edge thereof for restricting upward movement of the heat-sensitive tape 4. The restricting part 383 is a protruding piece that protrudes forward from the top edge of the restricting wall 33. A vertical distance between the lower restricting parts 381B and 382B and the restricting part 383 is equivalent to the width of the heat-sensitive tape 4.

As illustrated in FIG. 8, a fixing groove 331 is provided in the upper case 311 at a position corresponding to the restricting wall 33 of the lower case 312. The fixing groove 331 is a groove part having the same shape as the restricting wall 33 in a plan view. When assembling the upper case 311 and lower case 312, the top edge of the restricting wall 33 is fitted into the fixing groove 331 to fix the upper case 311 to the lower case 312. Upper restricting parts 381A and 382A are disposed adjacent to left and right end portions of the fixing groove 331. The upper restricting parts 381A and 382A extend slightly downward from the top plate 305 and also extend forward from the fixing groove 331 to the upper arm front wall 35A.

A head peripheral wall 36 extends rearward from the right edge of the arm rear wall 37 and then extends parallel to the arm rear wall 37. The head peripheral wall 36 is configured of a combination of an upper head peripheral wall 36A provided in the upper case 311, and a lower head peripheral wall 36B provided in the lower case 312.

The arm rear wall 37 and head peripheral wall 36 define a space that has a general rectangular shape in a plan view and that penetrates the tape cassette 30 vertically. This space is defined as a head insertion section 39. The head insertion section 39 is in communication with the exterior of the tape cassette 30 on the front side thereof through an exposing area 77 formed in the front surface side of the tape cassette 30 (see FIGS. 3 and 5). While the tape cassette 30 is mounted in the attachment portion 8, the head holder 19 is inserted in the head insertion section 39.

As illustrated in FIGS. 5 and 6, a restricting guide part 61 is provided on the left side of the head insertion section 39.

The restricting guide part 61 is positioned between the opening 341 and the conveying roller 56 described later with respect to the left-right direction. The restricting guide part 61 includes restricting members 361 and 362, a guide wall 58, and a partitioning wall 53. The restricting member 361 is a plate-shaped body that extends downward from the top plate 305. The restricting member 362 is a plate-shaped body that extends upward from the bottom plate 306 toward the restricting member 361.

Figure 9:
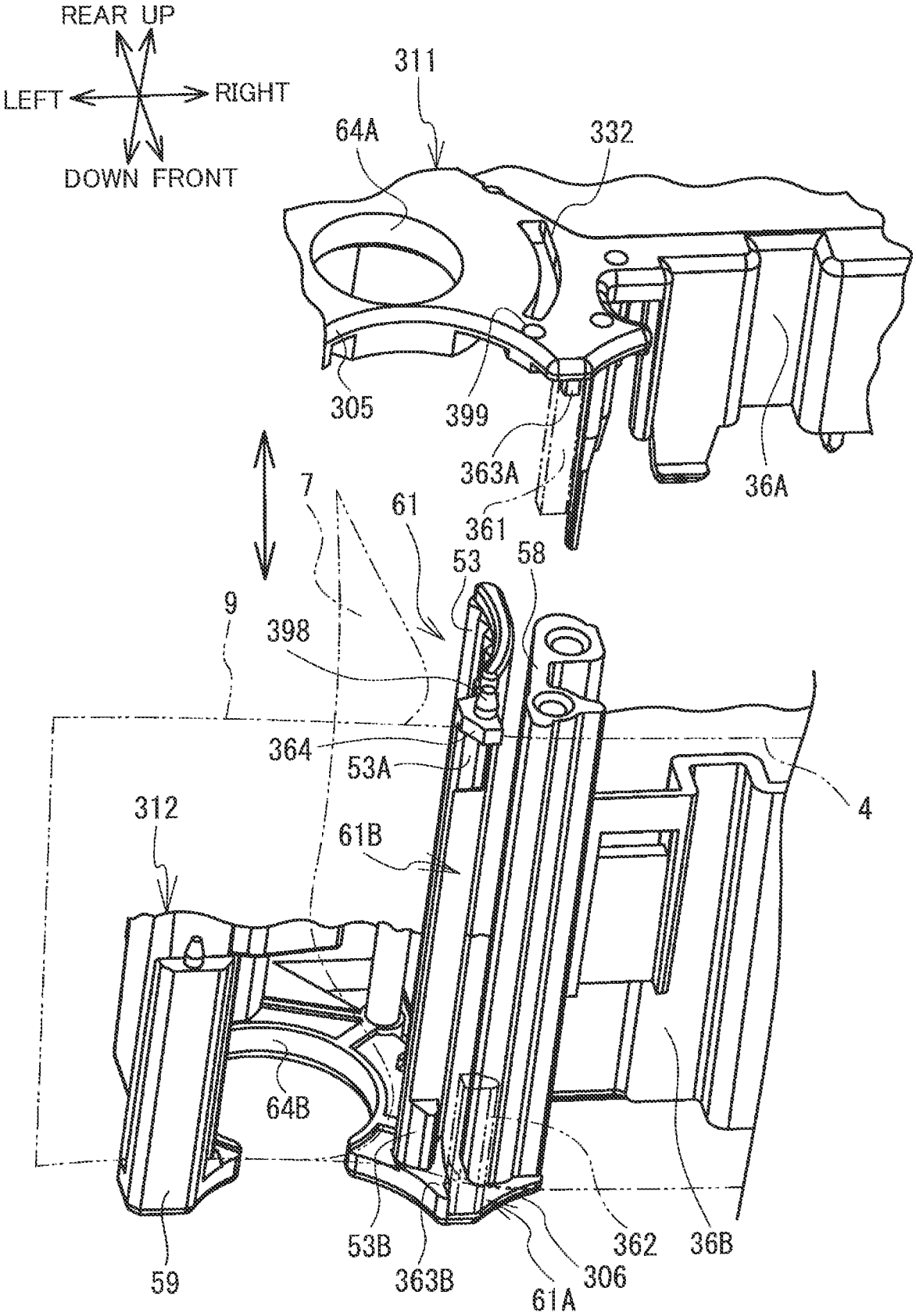
FIG. 9 is an exploded perspective view of a restricting guide part 61 disassembled into parts belonging to the upper case 311 and parts belonging to the lower case 312.

As illustrated in FIG. 9, the guide wall 58 is a wall portion of the lower head peripheral wall 36B that extends in the front-rear direction on the left side of the head insertion section 39. The partitioning wall 53 is provided in an upright state to the rear side of the guide wall 58. The partitioning wall 53 is disposed between the guide wall 58 and an opening 64B described later with respect to the left-right direction. The partitioning wall 53 is curved to form a gentle arcuate shape with respect to the front-rear direction of the cassette case 31 in conformance with a portion of the opening 64B in a plan view. The partitioning wall 53 has a left surface formed with a sawtooth shape in a plan view.

The guide wall 58 and restricting member 362 define therebetween a long vertical gap functioning as a lower portion of an inlet 61A. The inlet 61A communicates with the exposing area 77 and is part of the conveying path for the heat-sensitive tape 4. Hereinafter, the conveying path of the heat-sensitive tape 4 will be called the "first conveying path." The inlet 61A guides the heat-sensitive tape 4 into the restricting guide part 61. The partitioning wall 53 and restricting member 362 define therebetween a long vertical gap functioning as a lower portion of a guide hole 61B. The guide hole 61B is part of the first conveying path, and is positioned downstream of the inlet 61A so as to be formed continuously therewith. The guide hole 61B guides the heat-sensitive tape 4 toward the front of the conveying roller 56 described later (see FIG. 4).

The top surface of the bottom plate 306 at a bottom end portion of the inlet 61A is formed as a flat continuous surface free of unevenness. However, a lower restricting part 363B is provided along a base end of the partitioning wall 53 and a base end of the restricting member 362 so as to protrude slightly upward from the bottom plate 306. Thus, the bottom end portion of the guide hole 61B (i.e., a protruding end of the lower restricting part 363B) is positioned above the bottom end portion of the inlet 61A (i.e., the top surface of the bottom plate 306). In other words, the lower restricting part 363B forms a step whereby the bottom end portion of the guide hole 61B is higher than the bottom end portion of the inlet 61A.

A restricting part 364 is provided on a top end of the partitioning wall 53 as a protruding piece that protrudes forward from a front surface of the partitioning wall 53. A protruding part 398 is provided on the top of the restricting part 364. The protruding part 398 is a pin that protrudes upward. The lower restricting part 363B and restricting part 364 define therebetween a vertical distance which is equivalent to the width of the heat-sensitive tape 4. Restricting parts 53A and 53B are provided on the front surface of the partitioning wall 53. The restricting part 53A is a step part provided below the restricting part 364 that protrudes slightly forward from the front surface of the partitioning wall 53. The restricting part 53B is a step part provided on the base end of the partitioning wall 53 that protrudes slightly forward from the front surface of the partitioning wall 53.

As illustrated in FIG. 9, a fixing groove 332 is formed in the top plate 305 at a position corresponding to the partitioning wall 53 of the lower case 312. The fixing groove 332 is a groove part having the same shape as the partitioning wall 53 in a plan view. A fixing hole 399 is formed in the top plate 305 at a position corresponding to the protruding part 398 provided on the partitioning wall 53. The fixing hole 399 has the same diameter as the protruding part 398. When the upper case 311 is assembled to the lower case 312, the top end of the partitioning wall 53 is fitted into the fixing groove 332 and the protruding part 398 is fitted into the fixing hole 399 to fix the upper case 311 to the lower case 312.

The restricting member 361 is provided at a position frontward of the fixing groove 332. When the upper case 311 is assembled to the lower case 312, the guide wall 58 and restricting member 361 define therebetween a long vertical gap that functions as an upper portion of the inlet 61A. The partitioning wall 53 and restricting member 361 define therebetween a long vertical gap that functions as an upper portion of the guide hole 61B.

The bottom surface of the top plate 305 at an upper end portion of the inlet 61A is formed as a continuous flat surface without unevenness. However, an upper restricting part 363A is provided along the fixing groove 332 and a base end of the restricting member 361 and protrudes slightly downward from the top plate 305. In other words, the upper restricting part 363A is provided at a position corresponding vertically to the lower restricting part 363B of the lower case 312 and functions as an upper end portion of the guide hole 61B. The upper end portion of the guide hole 61B (i.e., the protruding end of the upper restricting part 363A) is positioned lower than the upper end portion of the inlet 61A (i.e., the bottom surface of the top plate 305). In other words, the upper restricting part 363A forms a step whereby the upper end portion of the guide hole 61B is lower than the upper end portion of the inlet 61A.

As illustrated in FIGS. 3 through 5, the conveying roller 56 is provided leftward of the restricting guide part 61. The conveying roller 56 is cylindrical in shape and elongated vertically. The front portion of the conveying roller 56 is exposed on the front side of the cassette case 31. The conveying roller 56 supports the adhesive tape 7 while the heat-sensitive tape 4 and adhesive tape 7 are being guided through the guide hole 61B in an overlapped state. The conveying roller 56 is rotatably supported in a support hole 64 of the cassette case 31. As will be described later in greater detail, the conveying roller 56 bonds the heat-sensitive tape 4 and adhesive tape 7 together by pressing the heat-sensitive tape 4 and adhesive tape 7 in their superimposed state against the pinch roller 14, thereby producing the laminated tape 9.

As will be described later, the support hole 64 is constituted by an opening 64A (see FIG. 8) formed in the top plate 305, and the opening 64B (see FIG. 7) formed in the bottom plate 306. The openings 64A and 64B are through-holes provided in vertically corresponding positions of the cassette case 31. While the tape cassette 30 is mounted in the attachment portion 8, the drive shaft 18 is inserted inside the conveying roller 56.

A guide part 59 is provided in a left-front corner portion of the cassette case 31 to the left side of the conveying roller 56. The guide part 59 is formed in a slit-like shape that extends vertically. After the laminated tape 9 is conveyed past the conveying roller 56, the laminated tape 9 passes through the inside of the guide part 59. At this time, the guide part 59 supports the laminated tape 9 (in the state illustrated in FIG. 11A) on both widthwise sides thereof. Thus, the orientation of the laminated tape 9 can be maintained while the laminated tape 9 is discharged from the cassette case 31. That is, the guide part 59 guides the laminated tape 9 out of the cassette case 31.

Structure of the Heat-Sensitive Tape 4

In the following description, the top side and bottom side in FIG. 10 will be referred to as the top and bottom of each tape. In. FIG. 10, the width of each tape, the relationship between magnitudes of the tape widths, the thickness of each layer, and the relationship among magnitudes of the layer thicknesses are depicted schematically. However, the actual thickness of each layer and relationships among magnitudes of the layer thicknesses may be different from those depicted in FIG. 10 (this also applies to FIGS. 11, 12, and 17-19).

Figure 10A:
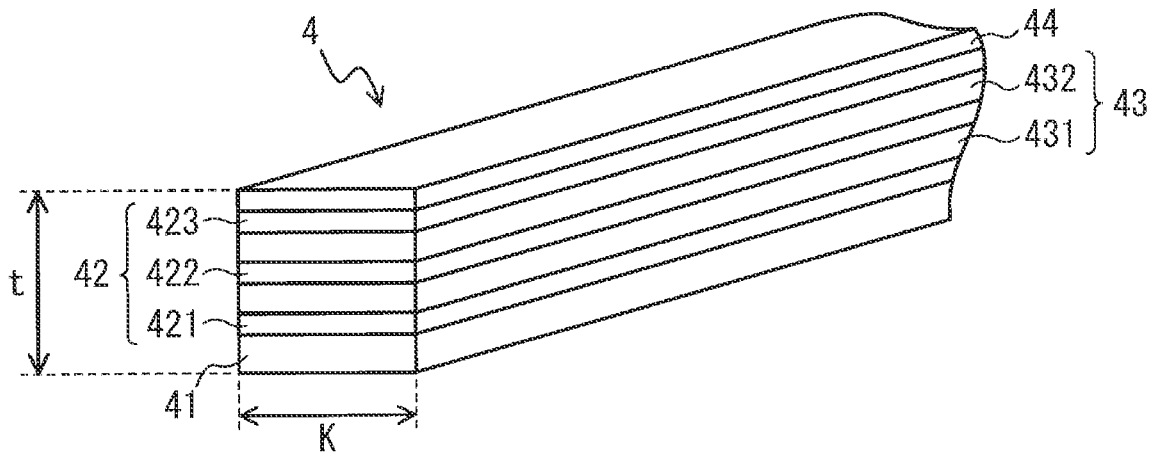
FIG. 10A is a perspective view illustrating layers of a heat-sensitive tape 4.

As illustrated in FIG. 10A, the heat-sensitive tape 4 is a long strip-like medium having a longitudinal direction (length direction) and a lateral direction (width direction). The heat-sensitive tape 4 is configured of a plurality of laminated layers. Specifically, the heat-sensitive tape 4 includes the base material 41, a plurality of heat-sensitive layers 42, a plurality of heat-insulating layers 43, and an overcoat layer 44 (hereinafter collectively referred to as the "layers of the heat-sensitive tape 4"). In the present embodiment, the heat-sensitive layers 42 include a first heat-sensitive layer 421, a second heat-sensitive layer 422, and a third heat-sensitive layer 423. The heat-insulating layers 43 include a first heat-insulating layer 431, and a second heat-insulating layer 432. The heat-sensitive tape 4 has a width K in the lateral direction, and a thickness t.

The base material 41, first heat-sensitive layer 421, first heat-insulating layer 431, second heat-sensitive layer 422, second heat-insulating layer 432, third heat-sensitive layer 423, and overcoat layer 44 are laminated in the thickness direction of the heat-sensitive tape 4 (the vertical direction in FIG. 10A) in the order given, beginning from the bottom of the heat-sensitive tape 4. Thus, the overcoat layer 44 is provided on the opposite side of the heat-sensitive layers 42 from the base material 41, and specifically constitutes a top surface of the heat-sensitive tape 4. In the following description, the surface of the base material 41 on which the first heat-sensitive layer 421 is laminated (bottom surface of the base material 41) will be called a first surface, while the surface of the base material 41 opposite the first surface (top surface of the base material 41) will be called a second surface.

The base material 41 is a resin film, and specifically a non-foamed resin film, and more specifically a non-foamed polyethylene terephthalate (PET) film. In other words, gas bubbles are not trapped inside the base material 41.

Each of the heat-sensitive layers 42 produces a corresponding color when heated to a color-developing temperature specific to that layer. The heat-sensitive layers 42 achieve this effect through the use of chemicals, such as those described in Japanese Patent Application Publication No. 2008-006830.

The first heat-sensitive layer 421 is formed as a film by coating a bottom surface of the first heat-insulating layer 431 with a chemical agent. When the first heat-sensitive layer 421 is heated above a first temperature, transparency of the first heat-sensitive layer 421 is lowered to produce a first color. In the present embodiment, the first color is cyan.

The second heat-sensitive layer 422 is formed as a film by coating a bottom surface of the second heat-insulating layer 432 with a chemical agent. When the second heat-sensitive layer 422 is heated above a second temperature, transparency of the second heat-sensitive layer 422 is lowered to produce a second color. The second temperature is higher than the first temperature. In the present embodiment, the second color is magenta.

The third heat-sensitive layer 423 is formed as a film by coating a top surface of the second heat-insulating layer 432 with a chemical agent. When the third heat-sensitive layer 423 is heated above a third temperature, transparency of the third heat-sensitive layer 423 is lowered to produce a third color. The third temperature is higher than the second temperature. In the present embodiment, the third color is yellow.

In the heat-sensitive tape 4 of the embodiment, the first color is cyan, the second color is magenta, and the third color is yellow. Hence, the first heat-sensitive layer 421, second heat-sensitive layer 422, and third heat-sensitive layer 423 together produce all three primary colors. Accordingly, the heat-sensitive tape 4 can display numerous colors by combining the primary colors produced in the heat-sensitive layers 42.

The heat-insulating layers 43 are sheet-like layers. Owing to their low thermal conductivity, the heat-insulating layers 43 function as resistance to heat conduction. Accordingly, a temperature gradient along a direction of heat transfer is produced within each of the heat-insulating layers 43. As will be described later, when the thermal head 10 applies heat to the heat-sensitive tape 4 from the top side in FIG. 10A, the temperature on the bottom surface of each layer of the heat-insulating layers 43 will be lower than the temperature on the top surface of the corresponding layer of the heat-insulating layers 43. In this way, each layer in the heat-insulating layers 43 can produce a desired difference in temperature between the two layers of the heat-sensitive layers 42 neighboring the corresponding layer in the heat-insulating layers 43 on the top and bottom sides thereof according to the thermal conductivity of each layer in the heat-insulating layers 43.

Specifically, the second heat-insulating layer 432 can produce a lower temperature in the second heat-sensitive layer 422 than the temperature in the third heat-sensitive layer 423. Similarly, the first heat-insulating layer 431 can produce a lower temperature in the first heat-sensitive layer 421 than the temperature in the second heat-sensitive layer 422. In this way, the heat-sensitive tape 4 can be designed to use the effect of the heat-insulating layers 43 to deliberately control the temperature of the first heat-sensitive layer 421 at a temperature higher than the first temperature and lower than the second temperature, the temperature of the second heat-sensitive layer 422 at a temperature higher than the second temperature and lower than the third temperature, and the temperature of the third heat-sensitive layer 423 at a temperature higher than the third temperature.

The overcoat layer 44 is formed as a film by coating a top surface of the third heat-sensitive layer 423. The overcoat layer 44 protects the heat-sensitive layers 42 on the opposite side from the base material 41 (i.e., from the top surface side of the heat-sensitive tape 4).

Overall, the heat-sensitive tape 4 has visible light transmittance (transparency) in the thickness direction of the heat-sensitive tape 4. In other words, each layer of the heat-sensitive tape 4 has transparency. The visible light transmittance (%) of the base material 41 may be the same as the visible light transmittance of one or more of the heat-sensitive layers 42, heat-insulating layers 43, and overcoat layer 44, or may be different from the visible light transmittance of any of these layers. The visible light transmittance (transparency) for each layer of the heat-sensitive tape 4 is at least 90%, for example, and preferably at least 99%, and more preferably at least 99.9%. Even if the visible light transmittance for each layer of the heat-sensitive tape 4 is less than 90%, the transparency of each layer may be sufficiently high as long as a user can visually recognize colors produced in the heat-sensitive layers 42 through the base material 41. The layers of the heat-sensitive tape 4 may all be transparent or translucent but are preferably transparent.

Structure of the Adhesive Tape 7

Figure 10B:
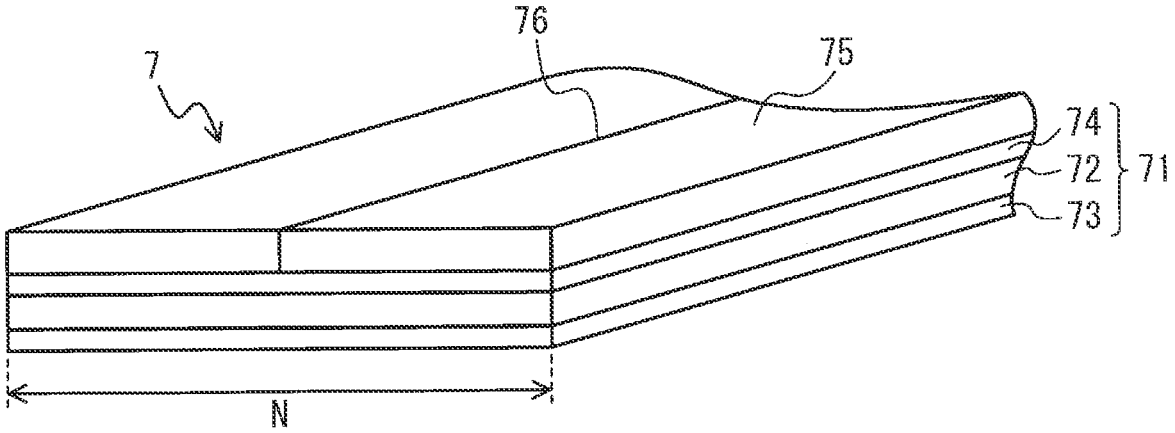
FIG. 10B is a perspective view illustrating layers of an adhesive tape 7.

As illustrated in FIG. 10B, the adhesive tape 7 is a long strip-like medium having a longitudinal direction (length direction) and a lateral direction (width direction). The adhesive tape 7 is configured of a plurality of laminated layers. Specifically, the adhesive tape 7 includes a double-sided adhesive tape 71, and the release paper 75. The double-sided adhesive tape 71 is white in color. The double-sided adhesive tape 71 includes a base material 72, the first adhesive layer 73, and the second adhesive layer 74. The base material 72 is white in color. Hence, the adhesive tape 7 of the embodiment does not have overall transparency in the thickness direction of the heat-sensitive tape 4. The base material 72 has a visible light transmittance lower than the visible light transmittance of each layer in the heat-sensitive tape 4.

The adhesive tape 7 has a width N in the lateral direction. In the present embodiment, the width N of the adhesive tape 7 is expressed by an equation (1) below using the width K and thickness t of the heat-sensitive tape 4.

$$N=K+2t \quad (1)$$

The first adhesive layer 73 is provided on a bottom surface of the base material 72. The second adhesive layer 74 is provided on a top surface of the base material 72. That is, the double-sided adhesive tape 71 is configured by applying adhesive to both top and bottom surfaces of the base material 72. The adhesive used for the first adhesive layer 73 and second adhesive layer 74 may be a urethane resin, silicone resin, vinyl resin, polyester resin, synthetic rubber, natural rubber, or acrylic resin type adhesive, for example.

The release paper 75 is bonded to the double-sided adhesive tape 71 through the second adhesive layer 74. A score line 76 is formed in the release paper 75. The score line 76 extends in the longitudinal direction of the adhesive tape 7 and divides the release paper 75 in two in the lateral direction. The score line 76 penetrates a portion of the double-sided adhesive tape 71 in a thickness direction thereof but does not reach the first adhesive layer 73. In other words, the base material 72 is continuously intact across the score line 76 and, thus, the double-sided adhesive tape 71 is continuously intact across the score line 76.

Structure of the Laminated Tape 9

In FIGS. 11A-B, 18A-B, and 19A-B, tapes are arranged so that a viewing direction Y1 (in which the user views each tape) coincides with a downward direction in each drawing. Thus, the top and bottom sides in FIGS. 11A-B, 18A-B, and 19A-B are opposite those in FIG. 10.

Figure 11A:
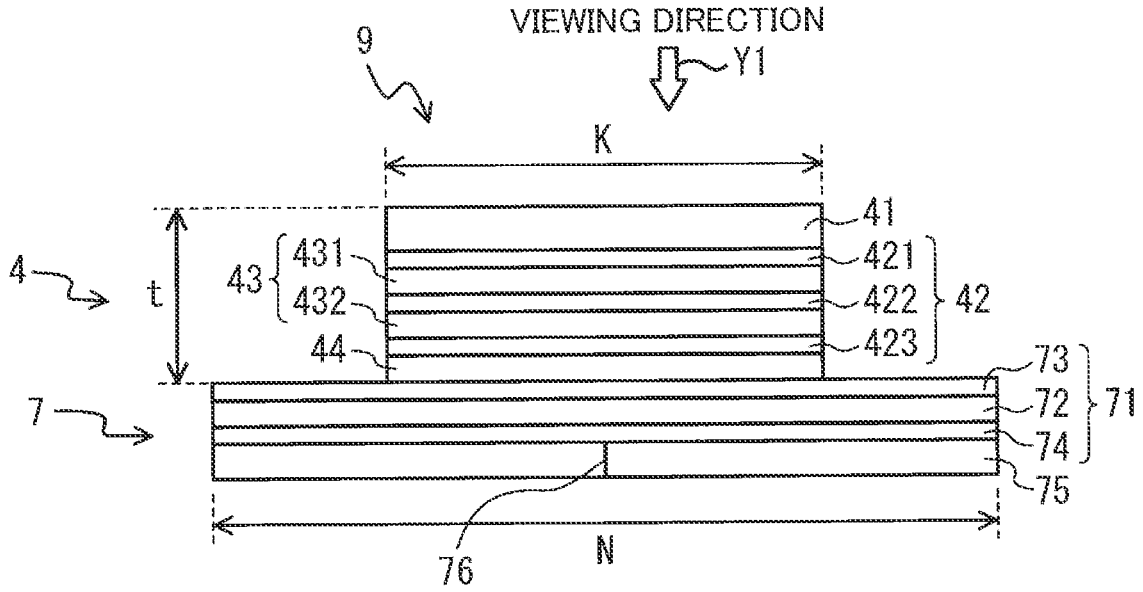
FIG. 11A is a front view illustrating layers of a laminated tape 9 configured of the heat-sensitive tape 4 and adhesive tape 7.

As illustrated in FIG. 11A, the laminated tape 9 is configured by bonding the bottom surface of the adhesive tape 7 to the top surface of the printed heat-sensitive tape 4. In other words, the adhesive tape 7 is bonded to the heat-sensitive tape 4 from the first surface side of the base material 41. i.e., such that the heat-sensitive layers 42 are positioned between the base material 41 and the adhesive tape 7 in the thickness direction. Accordingly, the laminated tape 9 is configured of the base material 41, first heat-sensitive layer 421, first heat-insulating layer 431, second heat-sensitive layer 422, second heat-insulating layer 432, third heat-sensitive layer 423, overcoat layer 44, first adhesive layer 73, base material 72, second adhesive layer 74, and release paper 75 that are stacked in the thickness direction in the order given.

The user views the laminated tape 9 from the second surface side of the base material 41 (i.e., the top side in FIG. 11A), as indicated by an arrow labeled as the viewing direction Y1. Since the heat-sensitive tape 4 has transparency as a whole, the user can see developed colors (i.e., printed images) in each of the heat-sensitive layers 42 through the base material 41, with the appearance of the adhesive tape 7 as the background, when viewing the laminated tape 9 from the base material 41 side. Since the double-sided adhesive tape 71 is white in the embodiment, the background of the laminated tape 9 appears white when the user views the laminated tape 9 from the base material 41 side. The user can use the laminated tape 9 by peeling the release paper 75 off the double-sided adhesive tape 71 and affixing the laminated tape 9 to a given wall, mount, or the like.

Conveying Paths for the Heat-Sensitive Tape 4 and Adhesive Tape 7

As illustrated in FIG. 4, the heat-sensitive tape 4 accommodated in the tape area 400 is drawn forward off the right side of the first supply roll 40 by the rotational drive of the conveying roller 56. A conveying direction of the first conveying path is coincident with the longitudinal direction of the heat-sensitive tape 4. Guided by the roller member 535 mounted over the shaft 533, the heat-sensitive tape 4 curves leftward in the right-front corner portion of the cassette case 31. The heat-sensitive tape 4 passing around the roller member 535 is smoothly fed toward the left-front corner of the cassette case 31 in association with the rotation of the roller member 535. At this time, the restricting part 384B (see FIG. 7) restricts downward movement of the heat-sensitive tape 4.

The heat-sensitive tape 4 conveyed around the roller member 535 (the shaft 533) passes between the arm front wall 35 and restricting wall 33 inside the arm part 34. At this time, the upper restricting parts 381A and 382A (see FIG. 8) and the restricting part 383 (see FIG. 6) restrict upward movement of the heat-sensitive tape 4, and the lower restricting parts 381B and 382B (see FIG. 7) restrict downward movement of the heat-sensitive tape 4. When passing the left end of the restricting wall 33, the heat-sensitive tape 4 passes between the restricting part 383 and lower restricting part 381B. Here, the restricting part 383 and the lower restricting part 381B define a vertical distance therebetween which is equivalent to the width K of the heat-sensitive tape 4. Subsequently, the heat-sensitive tape 4 exits the cassette case 31 through the opening 341.

Figure 12A:
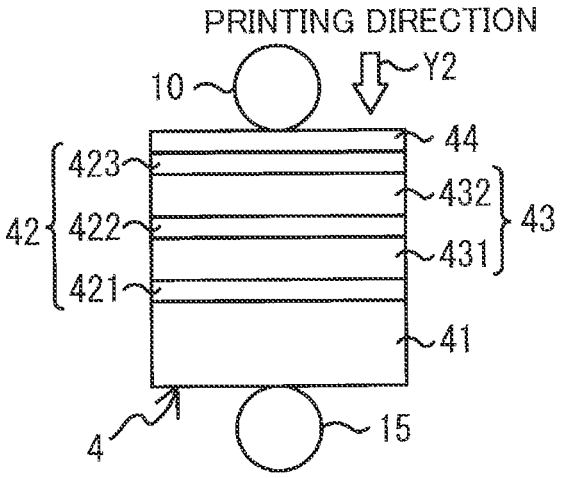
FIG. 12A is a plan view for describing printing on the heat-sensitive tape 4 by the thermal printer 1.

While in the exposing area 77, the side of the heat-sensitive tape 4 having the heat-sensitive layers 42 (the top side of the heat-sensitive tape 4) opposes the thermal head 10 while the base material 41 side of the heat-sensitive tape 4 (the bottom side of the heat-sensitive tape 4) opposes the platen roller 15, as illustrated in FIG. 12A. Thus, the thermal head 10 is positioned opposite to the base material 41 with respect to the heat-sensitive layers 42 (i.e., at the rear side of the heat-sensitive tape 4) while the tape cassette 30 is mounted in the attachment portion 8. Accordingly, the thermal head 10 heats the heat-sensitive tape 4 in the exposing area 77 on the opposite side of the heat-sensitive tape 4 from the base material 41 (in a direction indicated as a printing direction Y2).

The heat-sensitive tape 4 having been printed through heat applied by the thermal head 10 is conveyed toward the conveying roller 56 through the inlet 61A and guide hole 61B in the restricting guide part 61 illustrated in FIG. 9. At this time, the upper restricting part 363A and restricting part 364 restrict upward movement of the heat-sensitive tape 4 while the lower restricting part 363B restricts downward movement of the heat-sensitive tape 4. While passing through the guide hole 61B, the heat-sensitive tape 4 passes between the restricting part 364 and lower restricting part 363B. The restricting part 364 and lower restricting part 363B define a vertical distance therebetween which is equivalent to the width K of the heat-sensitive tape 4.

Figure 12B:
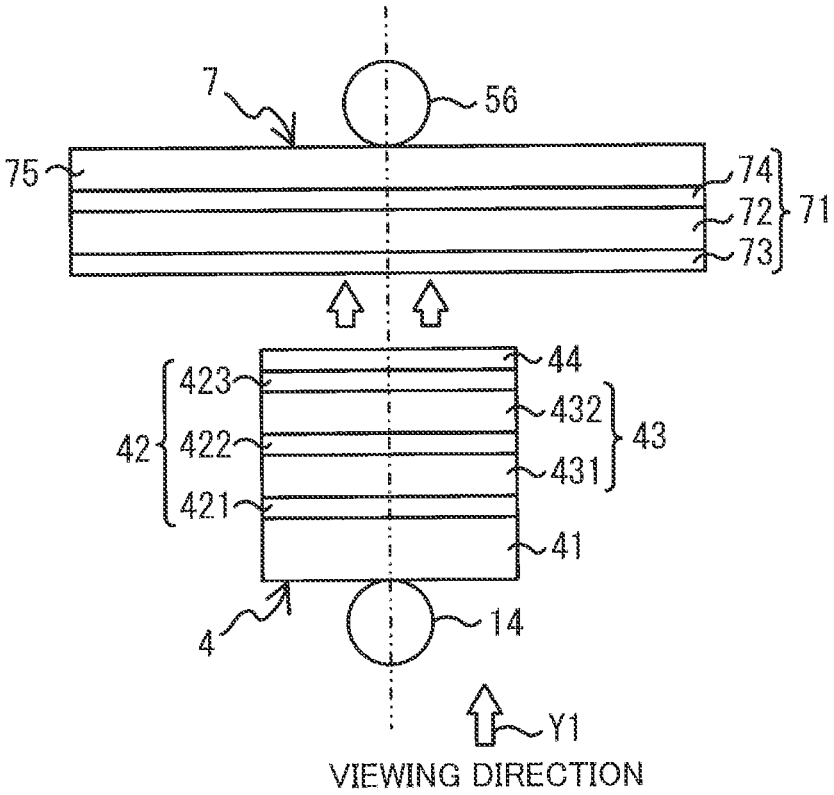
FIG. 12B is a plan view for describing bonding of the adhesive tape 7 to the printed heat-sensitive tape 4.

Having gone through the restricting guide part 61, the heat-sensitive tape 4 then passes between the conveying roller 56 and the pinch roller 14, as illustrated in FIG. 4. At this time, the side of the heat-sensitive tape 4 having the heat-sensitive layers 42 opposes the conveying roller 56, while the base material 41 side of the heat-sensitive tape 4 opposes the pinch roller 14, as illustrated in FIG. 12B.

In the present embodiment, the protruding ends of the lower restricting parts 401B, 381B, 382B, and 363B and the restricting part 384B are all set at the same height irrespective of location. Hence, the heat-sensitive tape 4 accommodated in the tape area 400 is maintained at the same vertical position as the heat-sensitive tape 4 present in the arm part 34 and in the restricting guide part 61, to restrict downward movement of the heat-sensitive tape 4 at each location.

As illustrated in FIG. 4, the adhesive tape 7 accommodated in the tape area 410 is drawn forward off the left side of the second supply roll 70 by the rotational drive of the conveying roller 56. Hereinafter, the conveying path of the adhesive tape 7 will be called a "second conveying path." A conveying direction of the second conveying path is coincident with the longitudinal direction of the adhesive tape 7. The adhesive tape 7 drawn off the second supply roll 70 subsequently curves leftward while being in contact with a right-front circumferential portion of the conveying roller 56. At this time, the release paper 75 side of the adhesive tape 7 (the top side of the adhesive tape 7) opposes the conveying roller 56 while the double-sided adhesive tape 71 side of the adhesive tape 7 (the bottom side of the adhesive tape 7) opposes the pinch roller 14, as illustrated in FIG. 12B. Accordingly, with the adhesive tape 7 overlapping the heat-sensitive tape 4 on the opposite side of the heat-sensitive layers 42 from the base material 41, the conveying roller 56 supports the adhesive tape 7 from the side of the adhesive tape 7 opposite the heat-sensitive tape 4 (i.e., from the release paper 75 side of the adhesive tape 7).

In the present embodiment, the protruding end of the lower restricting part 411B is set lower than the protruding end of the lower restricting part 401B by the thickness t of the heat-sensitive tape 4. Accordingly, the adhesive tape 7 accommodated in the tape area 410 is conveyed to the conveying roller 56 so that a vertical center of the adhesive tape 7 is aligned with a vertical center of the heat-sensitive tape 4 conveyed from the tape area 400.

While in their superimposed state, the heat-sensitive tape 4 and adhesive tape 7 are bonded together by being pinched between the pinch roller 14 and conveying roller 56, thereby forming the laminated tape 9 illustrated in FIG. 11A. As illustrated in FIG. 4, the laminated tape 9 is discharged from the cassette case 31 (tape cassette 30) after passing through the interior of the guide part 59. The laminated tape 9 is then conveyed to and cut by the cutting mechanism 16. Once being cut, the laminated tape 9 is discharged from the thermal printer 1 through the discharge slit formed in the device body 2.

Electrical Configuration of the Thermal Printer 1

Figure 13:
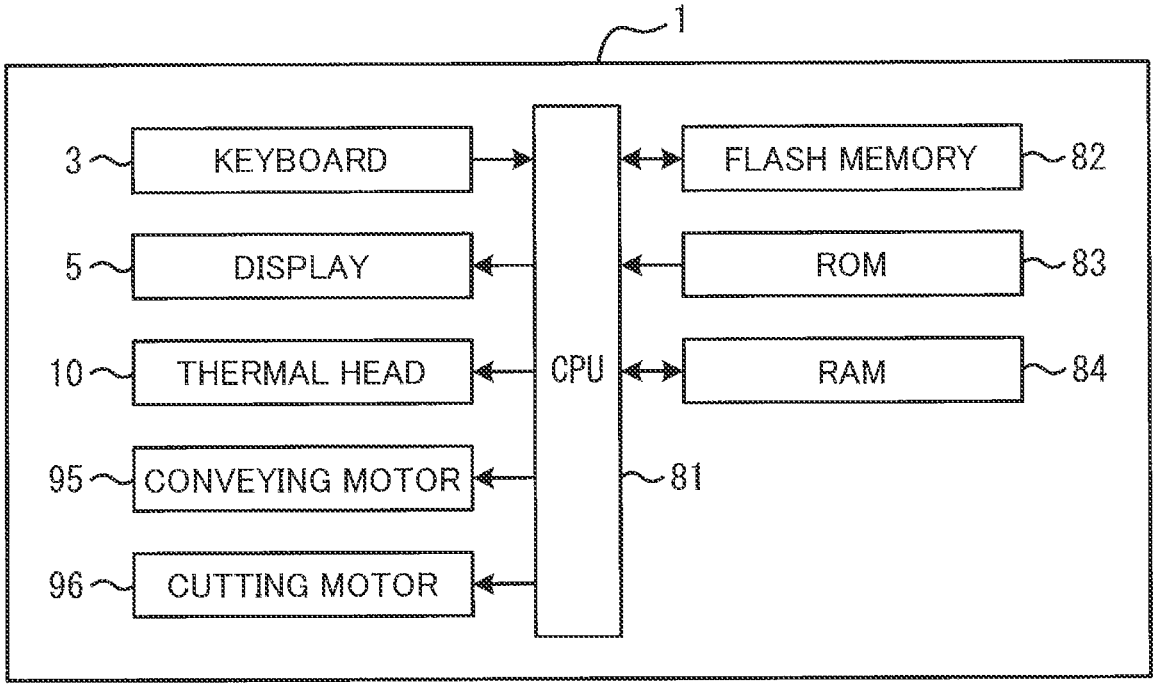
FIG. 13 is a block diagram illustrating an electrical configuration of the thermal printer 1.

As illustrated in FIG. 13, the thermal printer 1 also includes a CPU 81, a flash memory 82, a ROM 83, and a RAM 84. The CPU 81 functions as a processor for controlling the thermal printer 1. The CPU 81 is electrically connected to the flash memory 82, ROM 83, RAM 84, keyboard 3, display 5, thermal head 10, conveying motor 95, and cutting motor 96.

The flash memory 82 stores programs executed by the CPU 81. The ROM 83 stores various parameters required for executing the programs. The RAM 84 stores various temporary data, such as print data used for forming images.

Process for Creating Laminated Tape 9 on the Thermal Printer 1

The user inputs a print start command into the thermal printer 1 by operating the keyboard 3. Upon acquiring the print start command, the CPU 81 reads a program from the flash memory 82 and executes a laminated tape creating process illustrated in FIG. 14. In the laminated tape creating process, the CPU 81 controls the thermal printer 1 to perform printing operations in order to create the laminated tape 9.

Figure 14:
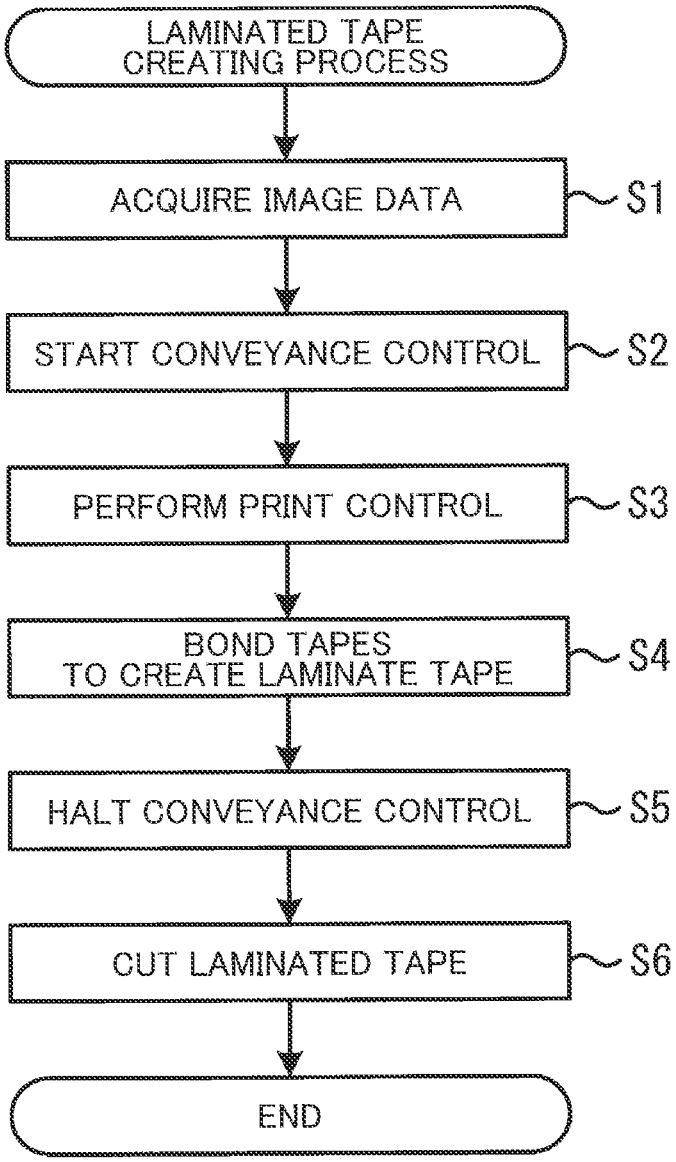
FIG. 14 is a flowchart explaining steps of a laminated tape creating process to be performed in the thermal printer 1.

Referring to FIG. 14, in S1 of the process, the CPU 81 acquires image data representing a user-specified image. The user specifies the image to be formed on the laminated tape 9 on the keyboard 3 in advance. The image to be formed on the laminated tape 9 is the image that can be seen by a user looking at the laminated tape 9 in the viewing direction Y1.

In S2, the CPU 81 begins conveyance control. In the conveyance control, the CPU 81 controls the conveying motor 95 to drive the drive shall 18 to rotate. As the drive shaft 18 is driven to rotate, the heat-sensitive tape 4 is pulled off the first supply roll 40 and the adhesive tape 7 is pulled off the second supply roll 70 through the cooperative operations of the conveying roller 56 and pinch roller 14. While the heat-sensitive tape 4 and adhesive tape 7 are conveyed at this time, the vertical centers of the heat-sensitive tape 4 and adhesive tape 7 are kept aligned by the lower restricting parts 401B, 411B, 381B, 382B, and 363B; the upper restricting parts 381A, 382A, and 363A; and the restricting parts 384B, 383 and 364.

In S3 the CPU 81 performs print control based on the image data acquired in S1. In the print control, the CPU 81 controls the thermal head 10. Specifically, while conveying the heat-sensitive tape 4, the CPU 81 selectively heats the heating elements 11. At this time, the thermal head 10 heats the heat-sensitive tape 4 on the side of the heat-sensitive layers 42 opposite the base material 41, as described above (see FIG. 12A).

In S4 the CPU 81 performs control to bond the adhesive tape 7 to the printed heat-sensitive tape 4. Specifically, by controlling the conveying motor 95 to rotate the drive shaft 18, the CPU 81 conveys the printed heat-sensitive tape 4 and adhesive tape 7 between the conveying roller 56 and pinch roller 14 so that the adhesive tape 7 is bonded to the printed heat-sensitive tape 4 on the side of the heat-sensitive layers 42 opposite the base material 41, thereby creating the laminated tape 9.

In S5 the CPU 81 halts the conveying motor 95, thereby halting the conveyance control that was initiated in S2. In S6 the CPU 81 controls the cutting motor 96 to cut the laminated tape 9 with the cutting mechanism 16. This completes the laminated tape creating process.

Technical Effects of the Embodiment

As described above, the laminated tape 9 is configured by bonding the bottom surface of the adhesive tape 7 to the top surface of the printed heat-sensitive tape 4. The heat-sensitive tape 4 has the base material 41, the heat-sensitive layers 42, the heat-insulating layers 43, and the overcoat layer 44. The heat-sensitive layers 42 including the third heat-sensitive layer 423 are provided on the first surface side of the base material 41. That is, the third heat-sensitive layer 423 is positioned between the base material 41 and the adhesive tape 7 in the thickness direction. The third heat-sensitive layer 423 produces the third color (yellow) when exceeding the third temperature. The adhesive tape 7 includes the double-sided adhesive tape 71. The double-sided adhesive tape 71 has the base material 72, the first adhesive layer 73, and the second adhesive layer 74. The width N of the adhesive tape 7 is larger than the width K of the heat-sensitive tape 4.

Figure 11B:
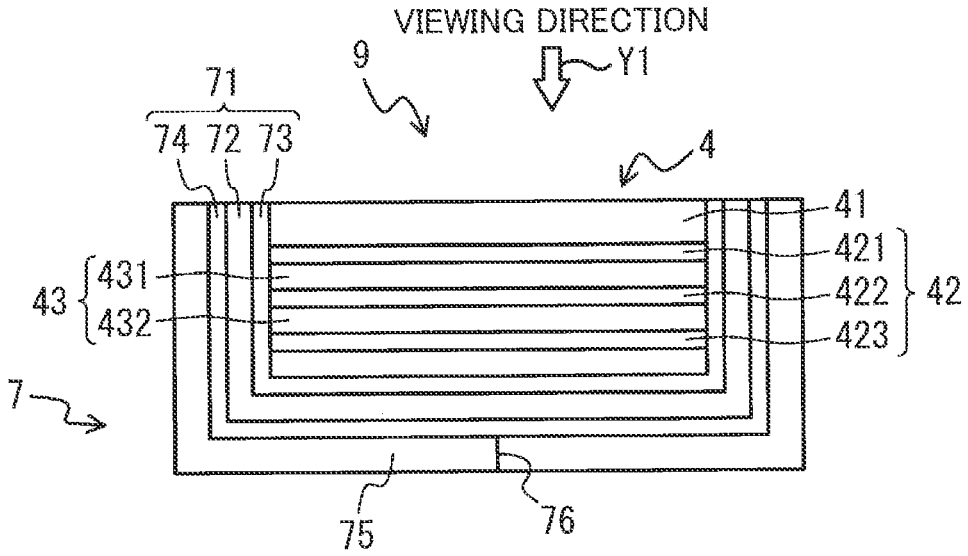
FIG. 11B is another front view illustrating the layers of the laminated tape 9.

Thus, when the heat-sensitive tape 4 and adhesive tape 7 are bonded together, the adhesive tape 7 protrudes out from the edges of the heat-sensitive tape 4 in the width direction, as illustrated in FIG. 11A. Accordingly, portions of the adhesive tape 7 that protrude from the heat-sensitive tape 4 in the width direction (hereinafter called the "protruding width portions") can cover and be bonded to the widthwise end faces of the heat-sensitive tape 4 by a user, as illustrated in FIG. 11B, after the laminated tape 9 illustrated in FIG. 11A is discharged out of the thermal printer 1. By covering the widthwise end faces of the heat-sensitive tape 4 with the adhesive tape 7 in this way, the laminated tape 9 according to the embodiment can improve durability thereof by suppressing moisture penetration, dirt adhesion, wear, and the like at the widthwise end faces of the heat-sensitive tape 4 owing simply to the portion of the adhesive tape 7 covering the heat-sensitive tape 4.

The heat-sensitive tape 4 also includes the first heat-sensitive layer 421 and second heat-sensitive layer 422, which are the heat-sensitive layers 42 disposed between the base material 41 and the third heat-sensitive layer 423. The first heat-sensitive layer 421 produces the first color (cyan) when exceeding the first temperature. The second heat-sensitive layer 422 produces the second color (magenta) when exceeding the second temperature. Through combinations of the third color produced in the third heat-sensitive layer 423, the first color produced in the first heat-sensitive layer 421, and the second color produced in the second heat-sensitive layer 422, the heat-sensitive tape 4 can express diverse color tones. Moreover, since the adhesive tape 7 covers the widthwise end faces of the heat-sensitive tape 4, the laminated tape 9 of the embodiment can suppress moisture and dirt from penetrating between the first through third heat-sensitive layers 421-423, for example. Therefore, the laminated tape 9 has enhanced durability while being able to express diverse color tones.

The base material 41 has transparency. The adhesive tape 7 is overlaid on the heat-sensitive tape 4 from the first surface side of the base material 41 such that the heat-sensitive layers 42 are sandwiched between the adhesive tape 7 and base material 41. Since the heat-sensitive layers 42 are interposed between the base material 41 and adhesive tape 7 in this case, the laminated tape 9 can improve durability with respect to moisture penetration, dirt adhesion, wear, and the like in the thickness direction.

The width N of the adhesive tape 7 satisfies the relationships in an inequality (2) below with respect to the width K and the thickness t of the heat-sensitive tape 4.

$$K<N\leq K+2t \tag{2}$$

In this case, the heat-sensitive tape 4 and adhesive tape 7 can be bonded together so that the length of each protruding width portion of the adhesive tape 7 is no greater than the thickness t of the heat-sensitive tape 4. Accordingly, the protruding width portions of the adhesive tape 7 do not protrude beyond the edges of the heat-sensitive tape 4 in the thickness direction when covering the widthwise end faces of the heat-sensitive tape 4. Therefore, the protruding width portions of the adhesive tape 7 are never bonded to anything other than the widthwise end faces of the heat-sensitive tape 4, as illustrated in FIG. 11B, improving user-friendliness of the laminated tape 9. In particular, in a case where the width N of the adhesive tape 7 is indicated by the equation (1) using the width K and thickness t of the heat-sensitive tape 4, the protruding width portions of the adhesive tape 7 can be bonded to the heat-sensitive tape 4 such that the protruding width portions cover the entire widthwise end faces of the heat-sensitive tape 4. In this case, the laminated tape 9 can further improve durability thereof with respect to moisture penetration, dirt adhesion, wear, and the like at the widthwise end faces of the heat-sensitive tape 4.

As described above, the tape cassette 30 includes the cassette case 31. The support hole parts 65 and 66 are provided inside the cassette case 31. The support hole part 65 rotatably supports the tape spool 21, and the support hole part 66 rotatably supports the tape spool 22. The heat-sensitive tape 4 is wound clockwise in a plan view about the tape spool 21 so as to gradually separate from the rotational center of the tape spool 21. The adhesive tape 7 is wound counterclockwise in a plan view about the tape spool 22 so as to gradually separate from the rotational center of the tape spool 22. With this configuration, the tape cassette 30 can supply the laminated tape 9 that is highly durable with respect to moisture penetration, dirt adhesion, wear, and the like at the widthwise end faces of the heat-sensitive tape 4.

In the tape cassette 30, the adhesive tape 7 is conveyed relative to the heat-sensitive tape 4 so that the adhesive tape 7 is overlaid on the heat-sensitive tape 4 from the first surface side of the base material 41 with the heat-sensitive layers 42 sandwiched between the adhesive tape 7 and base material 41. In this case, the user can view the colors developed in the heat-sensitive layers 42 from the base material 41 side of the laminated tape 9. Moreover, in the laminated tape 9, the adhesive tape 7 enhances durability with respect to moisture penetration, dirt adhesion, wear, and the like at the widthwise end faces of the heat-sensitive tape 4, while the base material 41 enhances durability of the top surface of the laminated tape 9.

The lower restricting parts 401B, 381B, 382B, and 363B; the upper restricting parts 401A, 381A, 382A, and 363A; and the restricting parts 383 and 364 are provided along the first conveying path. These restricting parts restrict the heat-sensitive tape 4 from moving vertically in the tape cassette 30, i.e., with respect to the width direction, when conveyed along the first conveying path. The lower restricting part 411B is provided on the second conveying path. The protruding end of the lower restricting part 411B is set lower than that of the lower restricting part 401B by the thickness t of the heat-sensitive tape 4. Hence, the adhesive tape 7 is conveyed by the conveying roller 56 so that its vertical center is aligned with the vertical center of the heat-sensitive tape 4. Consequently, the heat-sensitive tape 4 and adhesive tape 7 are bonded together with the adhesive tape 7 protruding beyond both widthwise edges of the heat-sensitive tape 4. In this way, the tape cassette 30 can provide the laminated tape 9 with high durability.

As described above, the CPU 81 performs the print control (S3). In this print control, the CPU 81 controls the thermal head 10 while controlling the conveying motor 95. Specifically, while conveying the heat-sensitive tape 4, the CPU 81 selectively heats the heating elements 11 in the thermal head 10. At this time, the heat-sensitive layers 42 in the heat-sensitive tape 4 are heated by the thermal head 10. Each of the heat-sensitive layers 42 produces a corresponding color when heated to the color-developing temperature specific to that layer. The CPU 81 performs control to bond the adhesive tape 7 to the printed heat-sensitive tape 4 (S4). Specifically, the CPU 81 controls the conveying motor 95 to convey the printed heat-sensitive tape 4 and adhesive tape 7. The adhesive tape 7 is bonded to the printed heat-sensitive tape 4 between the conveying roller 56 and pinch roller 14. Through this process, the printing system according to the embodiment can provide the laminated tape 9 having high durability with respect to moisture penetration, dirt adhesion, wear, and the like at the widthwise end faces of the heat-sensitive tape 4.

In S4, the adhesive tape 7 is overlapped on the heat-sensitive tape 4 from the first surface side of the base material 41 with the heat-sensitive layers 42 sandwiched therebetween. Since the heat-sensitive layers 42 are interposed between the base material 41 and adhesive tape 7 in this way, the printing system can provide the laminated tape 9 with high durability to moisture penetration, dirt adhesion, wear, and the like in the thickness direction.

As described above, the CPU 81 performs the conveyance control (S2). In the conveyance control, the heat-sensitive tape 4 and adhesive tape 7 are conveyed while the lower restricting parts 401B, 411B, 381B, 382B, and 363B; upper restricting parts 381A, 382A, and 363A; and restricting parts 384B, 383, and 364 position the heat-sensitive tape 4 and adhesive tape 7 such that their vertical centers are aligned. In this case, the heat-sensitive tape 4 and adhesive tape 7 are bonded together with the adhesive tape 7 protruding beyond both widthwise edges of the heat-sensitive tape 4. Thus, the printing system can provide the laminated tape 9 with high durability.

First Modification

Figure 15:
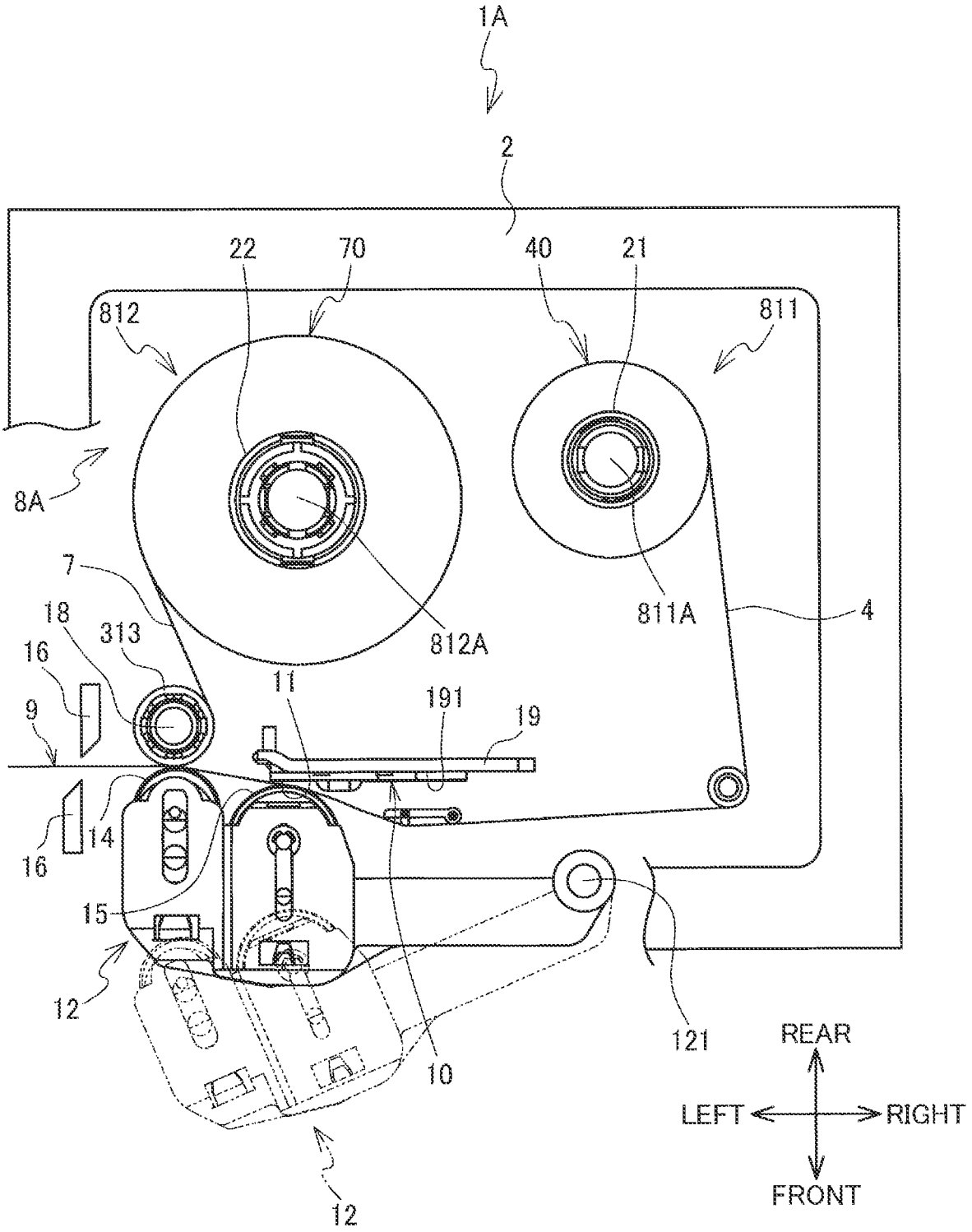
FIG. 15 is a plan view of an attachment portion 8A of a thermal printer 1A.

FIG. 15 shows a printing system according to a first modification to the embodiment. The first modification is different from the depicted embodiment in that the cassette case 31 of the tape cassette 30 is not provided. Specifically, a thermal printer 1A according to the first modification uses the same heat-sensitive tape 4 and adhesive tape 7 of the embodiment. The thermal printer 1A of the first modification is identical to the thermal printer 1 of the embodiment, except for the structure of the attachment portion 8. In the first modification, the same control (the laminated tape creating process) as that used in the embodiment is employed.

Hereinafter, like parts and components having the same functions as those in the depicted embodiment are designated with the same reference numerals and descriptions of these parts and components are omitted or simplified.

The thermal printer 1A includes an attachment portion 8A, in place of the attachment portion 8 of the embodiment. The attachment portion 8A includes a first attachment portion 811, and a second attachment portion 812. The first attachment portion 811 constitutes a right-rear section of the attachment portion 8A. A support shaft 811A is provided in the first attachment portion 811. The support shaft 811A extends vertically and is inserted into the first tape spool 21. The support shaft 811A rotatably supports the first tape spool 21. Thus, the first supply roll 40 is detachably mounted in the first attachment portion 811.

The second attachment portion 812 is positioned in a left-rear section of the attachment portion 8A, i.e., on the left side of the first attachment portion 811. A support shaft 812A is provided in the second attachment portion 812. The support shaft 812A extends vertically and is inserted into the second tape spool 22. The support shaft 812A rotatably supports the second tape spool 22. Thus, the second supply roll 70 is detachably mounted in the second attachment portion 812.

A conveying roller 313 is provided downstream (on the left side) of the thermal head 10 in the conveying direction. The conveying roller 313 is cylindrical in shape and is mounted on the drive shaft 18. The drive shaft 18 is configured to drive the conveying roller 313 to rotate. The pinch roller 14 can contact and separate from the conveying roller 313 along with the pivotal movement of the platen holder 12. In the printing position of the platen holder 12, the pinch roller 14 presses the heat-sensitive tape 4 and adhesive tape 7 against the conveying roller 313 with the heat-sensitive tape 4 and adhesive tape 7 overlapped with each other.

The heat-sensitive tape 4 is drawn frontward off the right side of the first supply roll 40, and then turned leftward at a right-front corner portion of the attachment portion 8A. The heat-sensitive tape 4 passes along the front side of the head holder 19. On the front side of the head holder 19, the heat-sensitive layer 42 side of the heat-sensitive tape 4 opposes the thermal head 10 while the base material 41 side of the heat-sensitive tape 4 opposes the platen roller 15. Thus, the thermal head 10 is positioned on the opposite side of the heat-sensitive layers 42 from the base material 41 (i.e., the rear side of the heat-sensitive tape 4). Accordingly, the thermal head 10 can heat the heat-sensitive tape 4 from the opposite side of the base material 41.

The heat-sensitive tape 4 passes between the conveying roller 313 and pinch roller 14 after passing along the front side of the head holder 19. At this time, the heat-sensitive layer 42 side of the heat-sensitive tape 4 opposes the conveying roller 313 while the base material 41 side of the heat-sensitive tape 4 opposes the pinch roller 14.

The adhesive tape 7 is pulled frontward from the left side of the second supply roll 70. The adhesive tape 7 then curves leftward while being in contact with a right-front circumferential portion of the conveying roller 313. At this time, the release paper 75 side of the adhesive tape 7 opposes the conveying roller 313, while the double-sided adhesive tape 71 side opposes the pinch roller 14. Accordingly, with the adhesive tape 7 overlapping the heat-sensitive tape 4 on the opposite side of the heat-sensitive layers 42 from the base material 41, the conveying roller 313 supports the adhesive tape 7 from the opposite side of the heat-sensitive tape 4.

With the heat-sensitive tape 4 and adhesive tape 7 superposed, the heat-sensitive tape 4 and adhesive tape 7 are bonded together between the pinch roller 14 and conveying roller 313, thereby forming the laminated tape 9.

As in the embodiment described above, the laminated tape 9 according to the first modification can enhance durability with respect to moisture penetration, dirt adhesion, wear, and the like at the widthwise end faces of the heat-sensitive tape 4.

Second Modification

Figure 16:
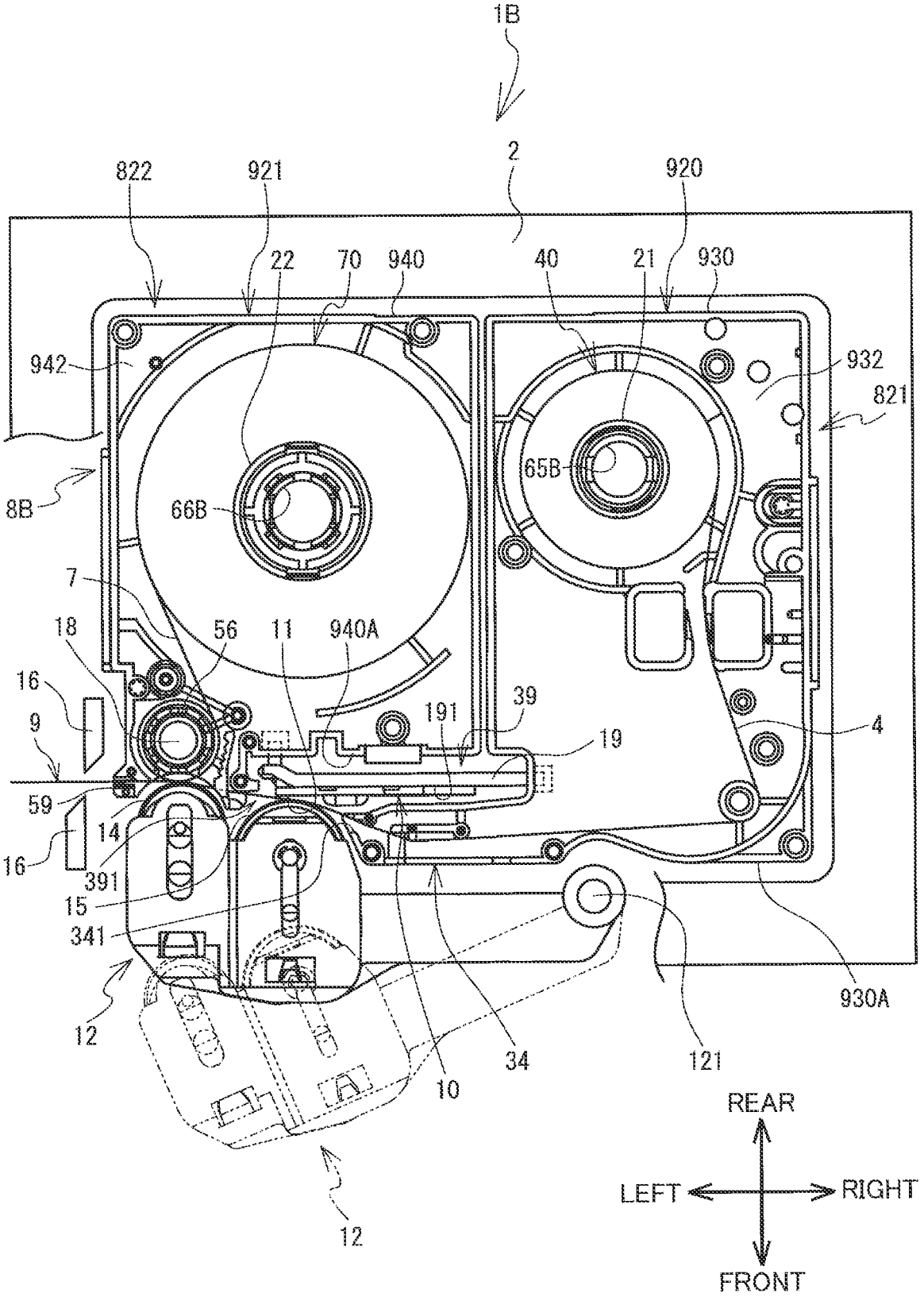
FIG. 16 is a plan view of an attachment portion 8B of a thermal printer 1B to which tape cassettes 920 and 930 are attached.

FIG. 16 illustrates a printing system according to a second modification to the embodiment. The printing system according to the second modification includes a thermal printer 1B, and tape cassettes 920 and 921. Unlike the embodiment described above, the second modification utilizes a plurality (two in this example) of tape cassettes 920 and 921, with the first supply roll 40 and second supply roll 70 accommodated in the tape cassette 920 and tape cassette 921, respectively. In the second modification, the same heat-sensitive tape 4 and adhesive tape 7 of the depicted embodiment are used. The thermal printer 1B of the second modification has the same configuration as the thermal printer 1 of the embodiment, except for the structure of the attachment portion 8. In the second modification, the same control (the laminated tape creating process) as that used in the embodiment is employed.

The thermal printer 1B includes an attachment portion 8B, in place of the attachment portion 8 of the embodiment. The attachment portion 8B includes a first attachment portion 821, and a second attachment portion 822. The first attachment portion 821 constitutes an approximate right half of the attachment portion 8B. The tape cassette 920 is detachably mounted in the first attachment portion 821. The second attachment portion 822 constitutes an approximate left half of the attachment portion 8B. The tape cassette 921 is detachably mounted in the second attachment portion 822.

The tape cassette 920 corresponds to a right-side portion of the tape cassette 30 of the embodiment, assuming that the tape cassette 30 is divided in half in the left-right direction between the first supply roll 40 and the second supply roll 70. The tape cassette 920 has a cassette case 930. The cassette case 930 has a general rectangular parallelepiped shape and is configured by assembling together a lower case 932, and an upper case (not shown). The first supply roll 40 is accommodated inside the cassette case 930. The arm part 34 is provided on a front surface 930A of the cassette case 930. The guide part 59 is provided at the cassette case 940.

The tape cassette 921 corresponds to a left-side portion of the tape cassette 30 of the embodiment, assuming that the tape cassette 30 is divided in half in the left-right direction between the first supply roll 40 and second supply roll 70. The tape cassette 921 has a cassette case 940. The cassette case 940 has a general rectangular parallelepiped shape and is configured by assembling together a lower case 942, and an upper case (not shown). The second supply roll 70 is accommodated inside the cassette case 940. The conveying roller 56 is disposed in a left-front corner portion of the cassette case 940. The head insertion section 39 is formed by the arm part 34 and a front surface 940A of the cassette case 940.

The heat-sensitive tape 4 is drawn frontward off the right side of the first supply roll 40, and then turned leftward in a right-front corner portion of the cassette case 930. The heat-sensitive tape 4 passes through the inside of the arm part 34 and subsequently exits the cassette case 930 through the opening 341.

While in a region corresponding to the exposing area 77 of the tape cassette 30, the side of the heat-sensitive tape 4 having the heat-sensitive layers 42 opposes the thermal head 10 while the base material 41 side of the heat-sensitive tape 4 opposes the platen roller 15. Thus, the thermal head 10 is positioned on the opposite side of the heat-sensitive layers 42 from the base material 41 (i.e., on the rear side of the heat-sensitive tape 4) while the tape cassette 920 is mounted in the first attachment portion 821 and the tape cassette 921 is mounted in the second attachment portion 822. Accordingly, the thermal head 10 can heat the heat-sensitive tape 4 from the opposite side of the base material 41 in the region corresponding to the exposing area 77.

The heat-sensitive tape 4 passes between the conveying roller 56 and pinch roller 14 through the region corresponding to the exposing area 77. At this time, the heat-sensitive layer 42 side of the heat-sensitive tape 4 opposes the conveying roller 56, while the base material 41 side of the heat-sensitive tape 4 opposes the pinch roller 14.

The adhesive tape 7 is pulled frontward from the left side of the second supply roll 70. The adhesive tape 7 curves leftward while being in contact with the right-front circumferential portion of the conveying roller 56. At this time, the release paper 75 side of the adhesive tape 7 opposes the conveying roller 56 while the double-sided adhesive tape 71 side opposes the pinch roller 14. Accordingly, with the adhesive tape 7 overlapping the heat-sensitive tape 4 on the opposite side of the heat-sensitive layers 42 from the base material 41, the conveying roller 56 supports the adhesive tape 7 from the opposite side of the heat-sensitive tape 4.

With the heat-sensitive tape 4 and adhesive tape 7 superposed, the heat-sensitive tape 4 and adhesive tape 7 are bonded together between the pinch roller 14 and conveying roller 56, thereby forming the laminated tape 9. The laminated tape 9 is discharged from the cassette case 940 after passing through the interior of the guide part 59.

As in the embodiment described above, the laminated tape 9 according to the second modification can enhance durability with respect to moisture penetration, dirt adhesion, wear, and the like at the widthwise end faces of the heat-sensitive tape 4.

Third Modification

Figure 17A:
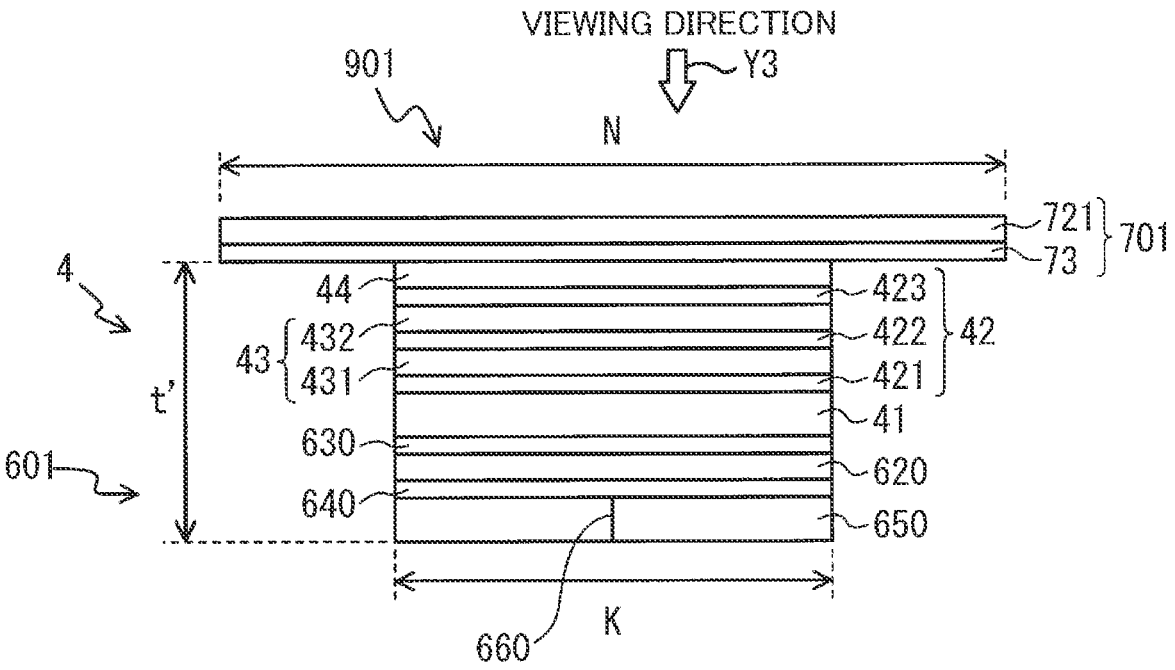
FIG. 17A is a front view illustrating layers of a laminated tape 901.
Figure 17B:
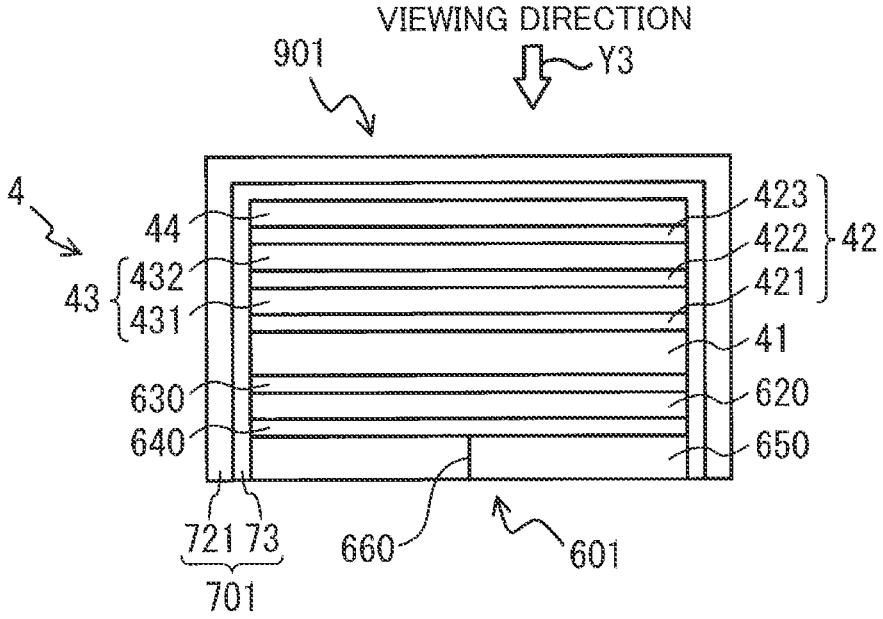
FIG. 17B is another front view illustrating the layers of the laminated tape 901.

A tape cassette of the third modification differs from the tape cassette 30 of the embodiment in that an adhesive tape 701 (illustrated in FIGS. 17A and 17B) is accommodated in the cassette case 31 as the second supply roll, in place of the adhesive tape 7. As illustrated in FIGS. 17A and 17B, the adhesive tape 701 is configured to include a transparent base material 721 in place of the white base material 72 and does not include the second adhesive layer 74 and release paper 75. Further, as the first supply roll, a combination of the heat-sensitive tape 4 and an adhesive tape 601 (separate from the adhesive tape 701) pre-bonded to the base material 41 of the heat-sensitive tape 4 is accommodated in the cassette case 31 of the tape cassette according to the third modification. Thus, the combination of the heat-sensitive tape 4 and adhesive tape 601 define a thickness t' greater than the thickness t of the heat-sensitive tape 4 alone.

The adhesive tape 601 is a long strip-like medium configured of a sheet 620, a first adhesive layer 630, a second adhesive layer 640, and a release paper 650. The adhesive tape 601 has the same length K as the heat-sensitive tape 4 in the width direction. The remaining structure of the adhesive tape 601 is identical to the adhesive tape 7 of the embodiment. In other words, the sheet 620 is equivalent to the base material 72 of the embodiment, the first adhesive layer 630 is equivalent to the first adhesive layer 73 of the embodiment, the second adhesive layer 640 is equivalent to the second adhesive layer 74 of the embodiment, the release paper 650 is equivalent to the release paper 75 of the embodiment, and a score line 660 provided in the release paper 650 is equivalent to the score line 76 of the embodiment.

The tape cassette 30C can also be used with the thermal printer 1 of the embodiment. That is, a printing system according to the third modification includes the thermal printer 1 and the tape cassette including the adhesive tape 701, the heat-sensitive tape 4 and the adhesive tape 601 illustrated in FIGS. 17A and 17B. Additionally, the same control described in the embodiment (the laminated tape creating process) is also performed in the third modification.

As illustrated in FIGS. 17A and 17B, a laminated tape 901 is created in the printing system of the third modification as a result of the laminated tape creating process. That is, the laminated tape 901 is created such that the adhesive tape 701 and the adhesive tape 601 sandwich the heat-sensitive tape 4 in the thickness direction. Since the base material 721 is transparent, the user can see the colors produced in the heat-sensitive layers 42 from the adhesive tape 701 side of the laminated tape 901 (i.e., from the first surface side of the base material 41; see a viewing direction Y3). Further, since the adhesive tape 701 covers the top surface of the laminated tape 901, the laminated tape 901 has improved durability with respect to moisture penetration, dirt adhesion, wear, and the like at the widthwise end faces of the heat-sensitive tape 4 when the laminated tape 901 is affixed to an object.

Fourth Modification

Figure 18A:
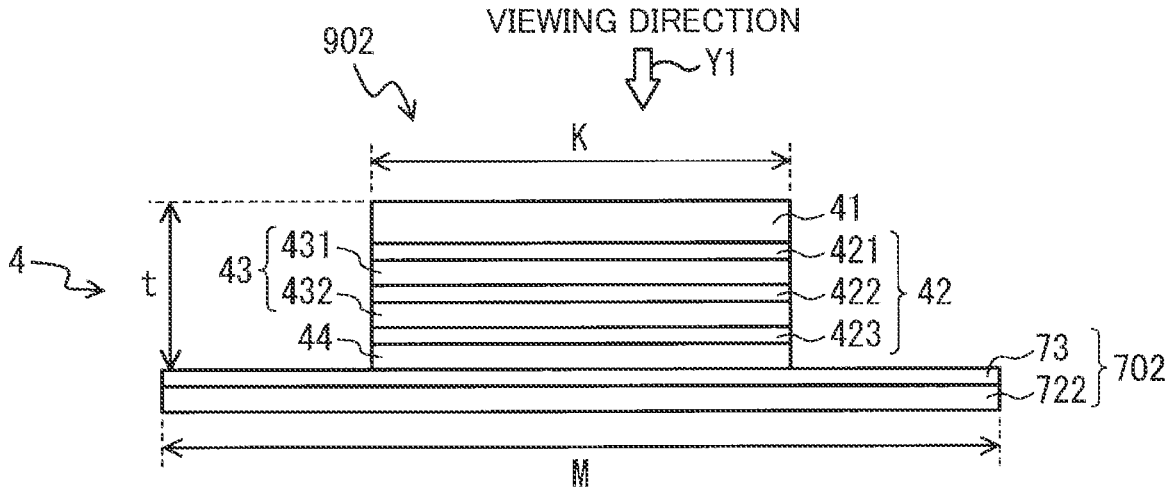
FIG. 18A is a front view illustrating layers of a laminated tape 902.
Figure 18B:
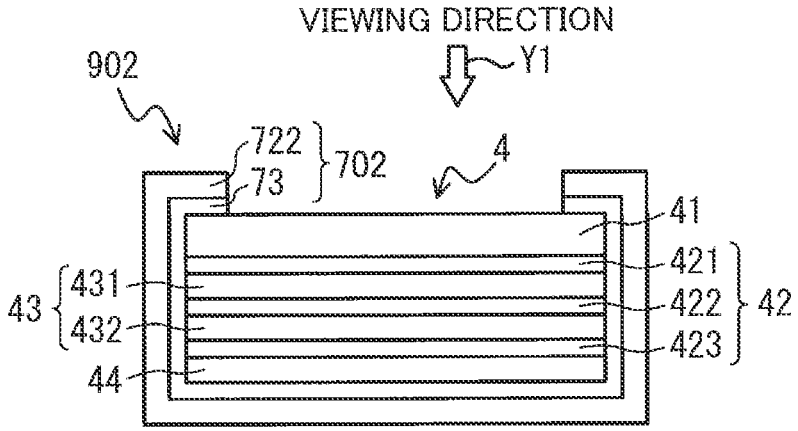
FIG. 18B is another front view illustrating the layers of the laminated tape 902.

A tape cassette of a fourth modification differs from the tape cassette 30 of the embodiment in that an adhesive tape 702 (illustrated in FIGS. 18A and 18B) is accommodated in the cassette case 31 in place of the adhesive tape 7. As illustrated in FIGS. 18A and 18B, the adhesive tape 702 has a width M that is greater than the width N of the adhesive tape 7. More specifically, the width M of the adhesive tape 702 satisfies the relationship in an inequality (3) below with respect to the width K and thickness t of the heat-sensitive tape 4.

$$K+2t<M \quad (3)$$

The adhesive tape 702 includes a base material 722, and the first adhesive layer 73. The base material 722 is transparent, but the remaining structure is identical to the base material 72 in the embodiment.

The tape cassette of the fourth modification can also be used with the thermal printer 1 of the embodiment. That is, a printing system according to the fourth modification includes the thermal printer 1 and the tape cassette including the adhesive tape 702, and the heat-sensitive tape 4 illustrated in FIGS. 18A and 18B. Moreover, the same control described in the embodiment (the laminated tape creating process) is also performed in the fourth modification.

As illustrated in FIGS. 18A and 18B, a laminated tape 902 is created in the printing system of the fourth modification as a result of the laminated tape creating process. In the fourth modification, the heat-sensitive tape 4 and adhesive tape 702 can be bonded together such that the length of each protruding width portion of the adhesive tape 702 is longer than the thickness t of the heat-sensitive tape 4. In this case, the protruding width portions of the adhesive tape 702 protrude past the edges of the heat-sensitive tape 4 in the thickness direction. Accordingly, the adhesive tape 702 that protrudes from the edges of the heat-sensitive tape 4 in the thickness direction can be bonded to the heat-sensitive tape 4, as illustrated in FIG. 18B. Hence, the fourth modification further increases the area of the heat-sensitive tape 4 covered by the protruding width portions of the adhesive tape 702. Accordingly, the laminated tape 902 can further increase durability with respect to moisture penetration, dirt adhesion, wear, and the like at the widthwise end faces of the heat-sensitive tape 4.

In this modification, the user may apply adhesive to the bottom surface of the laminated tape 9 (the surface of the base material 722 on the opposite side of the first adhesive layer 73) once the laminated tape 9 is completed, for example. Alternatively, the adhesive tape 702 may be self-adhesive.

Fifth Modification

Figure 19A:
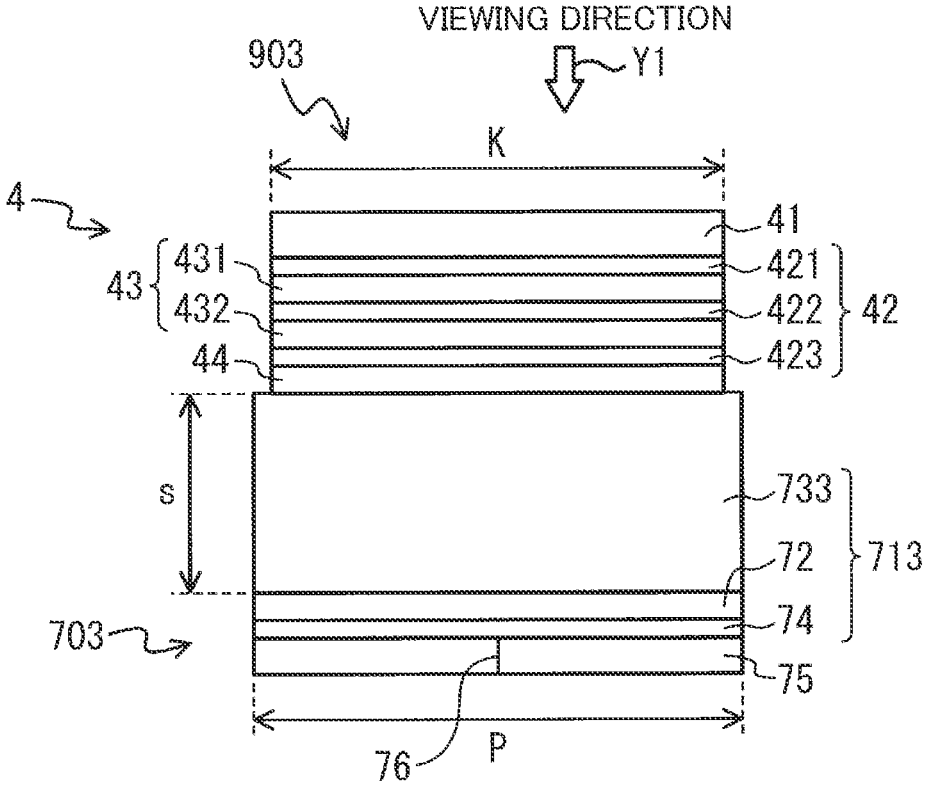
FIG. 19A is a front view illustrating layers of a laminated tape 903.
Figure 19B:
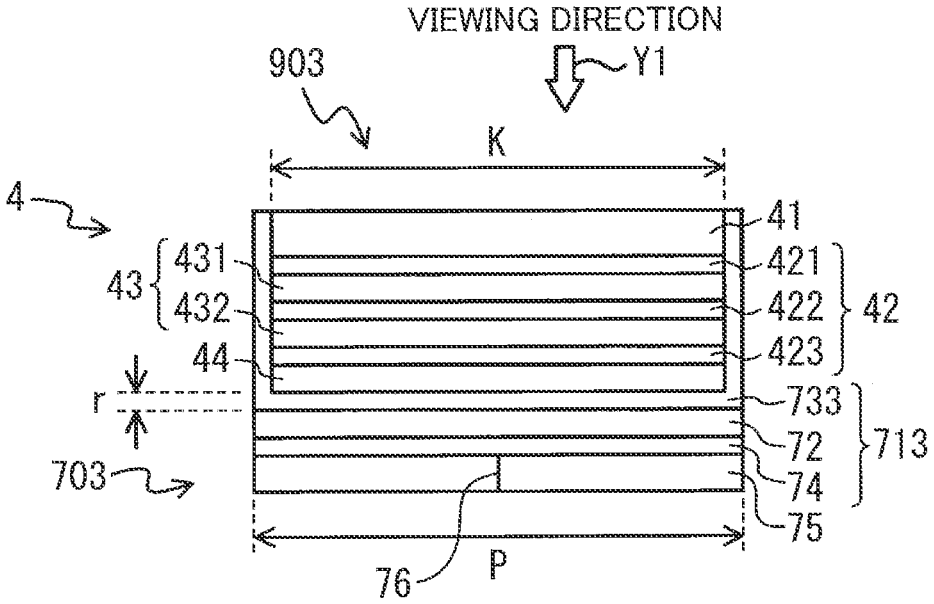
FIG. 19B is another front view illustrating the layers of the laminated tape 903.

A tape cassette according to a fifth modification differs from the tape cassette 30 of the embodiment in that an adhesive tape 703 (illustrated in FIGS. 19A and 19B) is accommodated in the cassette case 31 in place of the adhesive tape 7. Referring to FIGS. 19A and 19B, unlike the depicted embodiment, the adhesive tape 703 has a double-sided adhesive tape 713 configured to include a first adhesive layer 733 in place of the first adhesive layer 73. The first adhesive layer 733 is flexible and has a thickness s.

The tape cassette of the fifth modification can also be used in the thermal printer 1 of the embodiment. That is, a printing system according to the fifth modification includes the thermal printer 1 and the tape cassette including the adhesive tape 703 and the heat-sensitive tape 4 illustrated in FIGS. 19A and 19B. Moreover, the same control described in the embodiment (the laminated tape creating process) is also performed in the fifth modification.

As in the embodiment, a laminated tape 903 illustrated in FIG. 19B is created in the printing system of the fifth modification as a result of the laminated tape creating process. Since the first adhesive layer 733 is flexible, the heat-sensitive tape 4 and adhesive tape 703 can be bonded together in the fifth modification such that the heat-sensitive tape 4 sinks into the adhesive tape 703, as illustrated in FIG. 19B. Since the heat-sensitive tape 4 sinks into the adhesive tape 703 (more specifically, into the first adhesive layer 733), the thickness s of the first adhesive layer 733 sandwiched between the heat-sensitive tape 4 and base material 72 in the thickness direction is compressed to a thickness r. The widthwise end faces of the heat-sensitive tape 4 are covered by the adhesive tape 703 by such an amount that the heat-sensitive tape 4 sinks in the thickness direction (the difference between the thickness s and the thickness r). With this configuration as well, the laminated tape 903 can have further improved durability with respect to moisture penetration, dirt adhesion, wear, and the like of the heat-sensitive tape 4.

Other Variations

In addition to the first through fifth modifications described above, many modifications and variations may be made to the depicted embodiment.

For example, the base material 41 of the embodiment may be a foamed PET film. Alternatively, the base material 41 may be a resin film formed of polyethylene (PE), polypropylene (PP), ethylene vinyl acetate (EVA) copolymer, ethylene methacrylic acid (EMAA) copolymer, polybutene (PB), polybutadiene (BDR), polymethylpentene (PMP), polyethylene naphthalate (PEN), polybutylene terephthalate (PBT), polyimide (PI), polyetherimide (PEI), polyetherketone (PEK), polyether ether ketone (PEEK), nylon (NY), polyamide (PA), polycarbonate (PC), polystyrene (PS), foamed/expanded polystyrene (FS/EPS), polyvinyl chloride (PVC), polyvinylidene chloride (PVDC), saponified ethylene vinyl alcohol (EVOH), polyvinyl alcohol (PVA), plain transparent (PT) cellophane, moisture-proof sealable transparent (MST) cellophane, polyacrylonitrile (PAN), vinylon (VL), polyurethane (PU), triacetyl cellulose (TAC), or the like. In these cases, the base material 41 may be a foamed or a non-foamed resin film.

Since foamed resin has lower thermal conductivity than the same resin that is not foamed, the thermal conductivity of the base material 41 can be lowered through a simple construction when the base material 41 is configured of a foamed resin film. When the base material 41 has low thermal conductivity, heat inputted into the heat-sensitive tape 4 from the heat-sensitive layer 42 side is less likely to be diffused in the base material 41 when printing with the thermal printer 1. Accordingly, using a foamed resin film as the base material 41 can reduce the quantity of heat needed to be inputted into the heat-sensitive tape 4 for developing colors in the heat-sensitive layers 42 through a simple configuration. In other words, by using foamed resin film as the base material 41, the quantity of heat inputted into the heat-sensitive tape 4 for producing colors in the heat-sensitive layers 42 can be reduced without needing to use a special material in the base material 41 for reducing thermal conductivity.

When the adhesive tape 7 is bonded to the heat-sensitive tape 4 after the thermal printer 1 has performed printing on the heat-sensitive tape 4, the base material 41 functions as a laminating member for protecting the heat-sensitive layers 42. If the base material 41 has low thermal conductivity, the base material 41 can suppress unintended discoloration in the heat-sensitive layers 42 caused by heat inputted into the base material 41 side than when the base material 41 is formed of material having high thermal conductivity.

When the base material 41 is configured of non-foamed resin film, visible light transmittance of the base material 41 tends to be higher than when the base material 41 is formed of foamed resin film. Accordingly, the printed image in the laminated tape 9 will appear clear and distinct to the user.

Provided that the base material 41 has transparency sufficient for its application, the base material 41 may be formed of a metal foil (aluminum foil or copper foil), a vacuum metalized (VM) film, or the like, or may be configured of one of various types of paper, such as translucent paper, washi (traditional Japanese paper), wood-free paper, dust-free paper, glassine, clay-coated paper, resin-coated paper, laminated paper (polyethylene-laminated paper, polypropylene-laminated paper, etc.), synthetic paper, kraft paper, and the like. The base material 41 may also be formed of a nonwoven cloth or a glass cloth, for example.

The overcoat layer 44 may be made of a material identical to that of the heat-insulating layers 43. In other words, another heat-insulating layer (third heat-insulating layer) may be provided as the overcoat layer 44. Still alternatively, the overcoat layer 44 may be omitted. In this case, thermal conductivity from the thermal head 10 to the heat-sensitive layers 42 is enhanced, so that the thermal printer 1 can shorten a heating period by the thermal head 1, thereby reducing the cost required for the overcoat layer 44.

In the embodiment described above, the heat-sensitive tape 4 has a plurality of heat-sensitive layers 42. However, the heat-sensitive tape 4 may instead have just a single heat-sensitive layer. In this case, the base material 41, first heat-sensitive layer 421, first heat-insulating layer 431, and overcoat layer 44 are layered in the given order, for example. After the heat-sensitive tape 4 is printed, the adhesive tape 7 having the score line 76 is bonded to the side of the heat-sensitive tape 4 opposite the base material 41. Accordingly, the tape cassette 30 can suppress a deterioration in printing quality caused by the score line 76. That is, since the adhesive tape 7 is bonded to the heat-sensitive tape 4 after printing is performed on the heat-sensitive tape 4, the tape cassette 30 can suppress the generation of white lines in the printed result, not only when the heat-sensitive tape 4 has a plurality of heat-sensitive layers 42 but also when the heat-sensitive tape 4 has only a single heat-sensitive layer.

Note that both the first heat-insulating layer 431 and overcoat layer 44 may be omitted when the heat-sensitive tape 4 has only a single heat-sensitive layer. In this case, the single heat-sensitive layer may be formed by coating the top surface of the base material 41 with a chemical.

The heat-sensitive layers 42 in the embodiment may be configured by just two layers. In other words, the third heat-sensitive layer 423 may be omitted and, hence, the second heat-insulating layer 432 may also be omitted. In this case, the first heat-sensitive layer 421 may be formed by applying a chemical to the bottom surface of the first heat-insulating layer 431 while the second heat-sensitive layer 422 is formed by applying a chemical to the top surface of the first heat-insulating layer 431. Thus, it is sufficient for the heat-sensitive tape 4 to include at least one heat-insulating layer.

Alternatively, the heat-sensitive layers 42 may be configured by four or more layers. For example, a fourth heat-sensitive layer (not shown) may be provided on the opposite side of the third heat-sensitive layer 423 from the second heat-sensitive layer 422. In this case, the fourth heat-sensitive layer develops a fourth color when a fourth temperature is exceeded. The fourth temperature is higher than the third temperature. The fourth color may be black, for example. In this configuration, a third heat-insulating layer (not shown) is provided between the third heat-sensitive layer 423 and the fourth heat-sensitive layer in the thickness direction.

The first color, second color, and third color in the depicted embodiment may be colors other than cyan, magenta, and yellow. For example, the first, second, and third colors may all be the same color. When multiple layers of the same color are superimposed in the laminated tape 9, the laminated tape 9 can depict depth in the formed image.

The heat-sensitive layers 42 may be formed by applying chemical agent to the top surface of each of the heat-insulating layers 43. Alternatively, the heat-sensitive layers 42 may be pre-formed in sheets and bonded by adhesive to the respective heat-insulating layers 43.

At least one of the first adhesive layer 73 and second adhesive layer 74 may be colored or may be opaque. When the laminated tape 9 is being adhered to a prescribed wall, for example, the wall to which the laminated tape 9 is adhered becomes the background of the laminated tape 9 when the double-sided adhesive tape 71 is transparent or translucent (i.e., has transparency). Accordingly, the user can freely change the background according, to the wall to Which the laminated tape 9 is adhered.

The adhesive tape 7 of the embodiment may be configured by the base material 72 and first adhesive layer 73. In this case, the user may apply adhesive to the surface of the base material 72 on the side opposite the first adhesive layer 73 (i.e., the exposed surface) after completion of the laminated tape 9, for example. Alternatively, the adhesive tape 7 may be self-adhesive. When the adhesive tape 7 is thinner in this way, the size of the second supply roll 70 in the tape cassette 30 can be made smaller, thereby enabling the cassette case 31 to be more compact.

The score line 76 in the embodiment need not be formed in a straight line, but may be formed in a wavy line or the like. Further, a plurality of score lines 76 laterally juxtaposed may be formed in the release paper 75 rather than just a single score line 76. Alternatively, a plurality of score lines 76 extending laterally may be formed at prescribed intervals in the longitudinal direction of the release paper 75. The score lines 76 may also extend obliquely to the lateral and longitudinal directions.

The cassette case 31 in the embodiment described above may accommodate a first fanfold stack in place of the first supply roll 40. That is, the first fanfold stack may be accommodated in the cassette case 31 for supplying the heat-sensitive tape 4 that has been accordion-folded into a stack. A second fanfold stack may be accommodated in the cassette case 31 in place of the second supply roll 70. In other words, the second fanfold stack may be accommodated in the cassette case 31 for supplying the adhesive tape 7 that has been accordion-folded into a stack.

The first supply roll 40 of the embodiment may be a coreless roll that omits the first tape spool 21. Similarly, the second supply roll 70 may be a coreless roll that omits the second tape spool 22.

The conveying roller 56 may be provided as part of the thermal printer 1 rather than the tape cassette 30. In other words, the conveying roller 56 may be pre-mounted on the drive shaft 18, and the printed heat-sensitive tape 4 and adhesive tape 7 may be bonded together by members on the thermal printer 1 side (the conveying roller 56 pre-mounted on the drive shaft 18, and the pinch roller 14).

In the embodiment described above, the processing of S1 may be executed by an external device connected to the thermal printer 1, such as a personal computer or a smartphone. Additionally, the processing of S4 may be omitted. The user may manually cut the laminated tape 9, for example. Further, the cutting mechanism 16 may also execute a half cut in which the heat-sensitive tape 4 of the laminated tape 9 is cut entirely in its thickness direction while the adhesive tape 7 is left continuously intact in the longitudinal direction at the cutting position.

The user may also manually bond the printed heat-sensitive tape 4 to the adhesive tape 7. In this case, the thermal printer 1 need not be provided with a mechanism for bonding the heat-sensitive tape 4 to the adhesive tape 7.

Further, a portion of the top surface, bottom surface, and side surfaces of the cassette case 31 may be eliminated. The conveying roller 56 may also be a non-rotatable body, such as a fixed cylindrical body or plate-shaped body. In this case, the drive force of the conveying motor 95 may be transmitted to the pinch roller 14, for example.

In place of the CPU 81, the thermal printer 1 may employ a microcomputer, application-specific integrated circuits (ASICs), field-programmable gate arrays (FPGAs), or the like as the processor. The process for creating a laminated tape may be a distributed process performed by a plurality of processors. The non-transitory storage medium may be any storage medium capable of storing information, regardless of the duration that the information is stored. The non-transitory storage medium need not include transitory storage media (conveyed signals, for example). The program may be downloaded from a server connected to a network (i.e., transmitted as a transmission signal) and stored in the flash memory 82, for example. In this case, the program may be saved in a non-transitory storage medium, such as a hard disk drive provided in the server.

The variations described above may be combined in any way that does not produce inconsistencies.

While the description has been made in detail with reference to the embodiments, it would be apparent to those skilled in the art that many modifications and variations may be made thereto.

REMARKS

The heat-sensitive tape 4 is an example of a heat-sensitive medium. The adhesive tape 7 is an example of an adhesive medium. The laminated tape 9, 901, 902, 903 is an example of a medium. The base material 41 is an example of a base material. The third heat-sensitive layer 423 is an example of a first heat sensitive layer. The first and second heat-sensitive layers 421, 422 are examples of a second heat-sensitive layer. The base material 72, 721, 722 is an example of an adhesive-medium base material. The adhesive layer 73, 74, 733 is an example of an adhesive layer. The cassette case 31 is an example of a case. The support hole part 65 is an example of a first supporting portion. The support hole part 66 is an example of a second supporting portion. The thermal printer 1, 1A, 1B is an example of a thermal printer. The linear protruding parts of the lower restricting part 401B, restricting part 384B, upper restricting part 381A, lower restricting part 382B, lower restricting part 381B, restricting part 383, upper restricting part 363A, restricting part 364, lower restricting part 363B are examples of a first restricting portion. The linear protruding parts of the lower restricting part 411*b* is an example of a second restricting portion.

What is claimed is:

1. A medium for use in a thermal printer, the medium comprising:

a heat-sensitive medium defining a thickness in a thickness direction and a width in a width direction crossing the thickness direction, the heat-sensitive medium comprising:

a base material; and a first heat-sensitive layer configured to produce a first color when heated above a first temperature; and an adhesive medium laminated over the heat-sensitive medium in the thickness direction, the first heat-sensitive layer being positioned between the base material and the adhesive medium in the thickness direction, the adhesive medium comprising:

an adhesive-medium base material; and an adhesive layer provided at the adhesive-medium base material, wherein the adhesive medium defines a width greater than the width of the heat-sensitive medium in the width direction; and wherein the width of the adhesive medium is defined to satisfy an inequality $$K<N\leq K+2t,$$

in which:

N represents the width of the adhesive medium in the width direction;

K represents the width of the heat-sensitive medium in the width direction; and t represents the thickness of the heat-sensitive medium in the thickness direction.

2. The medium according to claim 1, wherein the heat-sensitive medium further comprises a second heat-sensitive layer interposed between the base material and the first heat-sensitive layer in the thickness direction, the second heat-sensitive layer being configured to produce a second color different from the first color when heated above a second temperature different from the first temperature.

3. The medium according to claim 2, wherein the heat-sensitive medium further comprises a heat-insulating layer interposed between the first heat-sensitive layer and the second heat-sensitive layer in the thickness direction.

4. The medium according to claim 1, wherein the base material has transparency, and wherein the adhesive medium is bonded to the heat-sensitive medium such that the first heat-sensitive layer is positioned between the base material and the adhesive medium in the thickness direction.

5. The medium according to claim 1, wherein the adhesive-medium base material has transparency, and wherein the adhesive medium is bonded to the heat-sensitive medium such that the first heat-sensitive layer is positioned between the base material and the adhesive medium in the thickness direction.

6. The medium according to claim 1, wherein the adhesive layer has flexibility in the thickness direction.

7. The medium according to claim 6, wherein the heat-sensitive medium is bonded to the adhesive medium such that the heat-sensitive medium sinks into the adhesive layer to reduce a thickness of the adhesive layer in the thickness direction.

8. A cartridge comprising:

a case accommodating the medium according to claim 1;

a first supporting portion provided at the case for supporting the heat-sensitive medium inside the case; and a second supporting portion provided at the case for supporting the adhesive medium inside the case.

9. The cartridge according to claim 8, wherein the case comprises a guide portion configured to guide the heat-sensitive medium to a position where the adhesive medium is laminated over and bonded to the heat-sensitive medium.

10. The cartridge according to claim 8, wherein the case further comprises:

a first conveying path for guiding the heat-sensitive medium in a longitudinal direction of the heat-sensitive medium from the first supporting portion;

a second conveying path for guiding the adhesive medium in a longitudinal direction of the adhesive medium from the second supporting portion; and a first restricting portion provided at the first conveying path and configured to restrict movement of the heat-sensitive medium in the width direction, and wherein the heat-sensitive medium passing through the first restricting portion is bonded to the adhesive medium conveyed along the second conveying path such that the adhesive medium protrudes out from widthwise edges of the heat-sensitive medium in the width direction.

11. The cartridge according to claim 10, wherein the case further comprises a second restricting portion provided at the second conveying path and configured to restrict movement of the adhesive medium in the width direction, and wherein the heat-sensitive medium passing through the first restricting portion along the first conveying path is bonded to the adhesive medium passing through the second restricting portion along the second conveying path such that the adhesive medium protrudes out from widthwise edges of the heat-sensitive medium in the width direction.

12. The cartridge according to claim 8, wherein the case further comprises:

a first conveying path for guiding the heat-sensitive medium in a longitudinal direction of the heat-sensitive medium from the first supporting portion;

a second conveying path for guiding the adhesive medium in a longitudinal direction of the adhesive medium from the second supporting portion;

a first restricting portion provided at the first conveying path and configured to restrict movement of the heat-sensitive medium in the width direction along the first conveying path; and a second restricting portion provided at the second conveying path and configured to restrict movement of the adhesive medium in the width direction along the second conveying path, and wherein the heat-sensitive medium passing through the first restricting portion and the adhesive medium passing through the second restricting portion are bonded together such that widthwise centers of the heat-sensitive medium and the adhesive medium are aligned with each other in the width direction.

13. A method for creating the medium according to claim 1, the method comprising:

a printing step to apply heat to the heat-sensitive medium to form an image in the heat-sensitive medium; and a laminating step to bond the adhesive medium to the heat-sensitive medium on which the image is formed to create the medium.

14. The method according to claim 13, wherein the base material has transparency, and wherein, in the laminating step, the adhesive medium is bonded to the heat-sensitive medium such that the first heat-sensitive layer is positioned between the base material and the adhesive medium in the thickness direction.

15. The method according to claim 13, wherein the adhesive-medium base material has transparency, and wherein, in the laminating step, the adhesive medium is bonded to the heat-sensitive medium such that the first heat-sensitive layer is positioned between the base material and the adhesive medium in the thickness direction.

16. The method according to claim 13, further comprising a positioning step to perform positioning of the heat-sensitive medium relative to the adhesive medium with respect to the width direction such that the adhesive medium protrudes out from widthwise edges of the heat-sensitive medium in the width direction, the positioning step being performed before the laminating step, wherein, in the laminating step, the adhesive medium is laminated and bonded to the heat-sensitive medium such that the adhesive medium protrudes out from widthwise edges of the heat-sensitive medium in the width direction.

* * * * *